US006217315B1

(12) United States Patent
Mifune et al.

(10) Patent No.: US 6,217,315 B1
(45) **Date of Patent: *Apr. 17, 2001**

(54) LIQUID FUEL BURNING DEVICE

(75) Inventors: Hideo Mifune; Yasuaki Nakamura; Takashi Tsukamoto, all of Shizuoka-ken (JP)

(73) Assignee: Tokai Corporation, Shizuoka-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/230,206

(22) PCT Filed: May 15, 1998

(86) PCT No.: PCT/JP98/02146

§ 371 Date: Jan. 20, 1999

§ 102(e) Date: Jan. 20, 1999

(87) PCT Pub. No.: WO98/53253

PCT Pub. Date: Nov. 26, 1998

(30) Foreign Application Priority Data

May 20, 1997 (JP) ..... 9-129400

(51) Int. Cl.[7] ..... F23D 3/18; F23D 14/28

(52) U.S. Cl. ..... 431/321; 431/150; 431/152; 431/344; 431/135; 431/153; 431/35; 431/86; 431/325; 431/322; 431/315; 126/96; 239/50

(58) Field of Search ..... 431/129, 130, 431/344, 135, 146, 150, 152, 147, 315, 25, 302, 303, 304, 309, 310, 312, 320, 321, 322, 324, 153, 35, 86; 126/96; 239/44, 45, 49, 50

(56) References Cited

U.S. PATENT DOCUMENTS

| | | | | |
|---|---|---|---|---|
| 398,503 | * | 2/1889 | Ellis | 431/312 |
| 1,134,314 | * | 4/1915 | Canchester | 431/146 |
| 2,190,928 | * | 2/1940 | Kovac | 431/146 |
| 2,301,453 | * | 11/1942 | Reich | 431/146 |
| 2,451,188 | * | 10/1948 | Konrad | 431/146 |
| 2,616,161 | * | 11/1952 | Reilly | 431/344 |
| 2,680,962 | * | 6/1954 | Lipic et al. | 431/152 |
| 2,743,597 | * | 5/1956 | Newman | 431/344 |
| 2,817,226 | * | 12/1957 | Dickman | 431/146 |
| 3,316,957 | * | 5/1967 | Stockli et al. | 431/152 |
| 3,382,028 | * | 5/1968 | Yoshinaga | 431/344 |
| 4,416,616 | * | 11/1983 | Shimizu et al. | 431/325 |
| 4,477,247 | * | 10/1984 | Kumasaka | 431/146 |
| 4,518,347 | * | 5/1985 | Sonetaka et al. | 431/325 |
| 4,526,530 | * | 7/1985 | Menter et al. | 431/321 |
| 4,557,687 | * | 12/1985 | Schirneker | 431/303 |
| 4,810,185 | * | 3/1989 | Nakamura et al. | 431/146 |
| 4,971,224 | * | 11/1990 | Scremin | 431/344 |

FOREIGN PATENT DOCUMENTS

| | | |
|---|---|---|
| 1730986 | 11/1962 | (JP) . |
| 39-2285 | 3/1964 | (JP) . |
| 41-7227 | 4/1966 | (JP) . |
| 57-92620 | 6/1982 | (JP) . |
| 41759 | 1/1992 | (JP) . |

* cited by examiner

*Primary Examiner*—Ira S. Lazarus
*Assistant Examiner*—Josiah C. Cocks
(74) *Attorney, Agent, or Firm*—BakerBotts, LLP

(57) ABSTRACT

A liquid fuel burning device comprising a wick for sucking and burning a liquid fuel contained in a fuel tank by capillarity and a vent passage which is provided in a portion other than a fuel passage used by the wick and allows communication between an interior of the fuel tank and the outside air at least during combustion.

22 Claims, 18 Drawing Sheets

LIQUID FUEL BURNING DEVICE

TECHNICAL FIELD

This invention relates to the structure of a lighter or other liquid fuel burner that uses an alcohol fuel or the like and is equipped with a wick for drawing up and burning a liquid fuel.

In particular, this invention relates to a wick peripheral structure for obtaining a desired burning state in a burner (e.g., a cigarette lighter, torch, lantern or other such fire-lighting device, lamp or the like) that uses a liquid fuel such as an alcohol, a benzine hydrocarbon or a petroleum hydrocarbon.

BACKGROUND TECHNOLOGY

An alcohol fuel such as ethyl alcohol, a benzine fuel of the petroleum benzine type or a liquid gas fuel such as butane gas or propane gas is generally used as the fuel of a cigarette lighter, fire-lighting device, torch, lamp or other such burner.

The performance, ease of use, and structural design of such burners differs depending on the kind of fuel used, and each has its own characteristics. In the case of a liquid gas fuel, for instance, the gas pressure is high in the use temperature range of the burner and the vessel storing the fuel has to have a pressure-resistant structure. Moreover, the flame length changes with variation in the gas pressure and since it is a characteristic of the gas pressure to vary logarithmically and greatly with temperature, large change in flame length with temperature becomes a particular problem. In order to reduce this flame-length variation, the fuel supply mechanism of the burner requires a special design countermeasure for effecting temperature compensation, which complicates the structure and is disadvantageous from the aspect of cost.

In contrast, since a liquid fuel such as an alcohol fuel is a liquid at ordinary temperatures and is also relatively low in vapor pressure, it does not require a pressure-resistant vessel in the fuel storage section and, as such, simplifies the structure of the burner and is advantageous from the aspect of cost. Further, in the liquid fuel burner, the means used to supply the liquid fuel from the fuel storage section to the flame-producing section is generally a wick that utilizes the surface tension of the liquid fuel to draw it up through continuous fine holes or fine voids among bundled fibers by capillarity and burns it at the tip portion thereof.

Specifically, the wick used for drawing up the fuel is a string-like one obtained by twisting fibers, one obtained by bundling fibers, one using both of these with the glass fibers enclosed in cotton yarn and the result interwoven with fine metal wires to prevent disintegration, or the like, whose the lower end portion functions to draw up fuel to be burned at the upper end tip portion.

However, the burner using such a wick has problems in that the liquid fuel leaks through the wick owing to the difference between the internal pressure of the fuel tank retaining the liquid fuel and the external pressure and that a phenomenon of drawing in external air arises.

Specifically, after draw-up and combustion of the alcohol or other liquid fuel by the wick has been initiated by lighting (igniting) the liquid fuel at the wick, liquid fuel is consumed at the flame-producing section at the tip of the wick and liquid fuel for maintaining the combustion is drawn up from the fuel tank and supplied to the flame-producing section. The flame length varies until an equilibrium is reached between the amount of liquid fuel consumed at the flame-producing section and the amount of fuel drawn up from the tank and supplied to the flame-producing section.

When the burner is a fire-lighting device such as a cigarette lighter, the flame is preferably stabilized at the set flame length as quickly as possible after ignition. For this, the draw-up section of the wick should preferably have the maximum possible liquid fuel draw-up capacity, while attention must also be given to preventing occurrence of a pressure differential between the fuel tank and the external air to ensure that the outflow of the liquid fuel from the fuel tank does not produce a reduced pressure state that hinders draw-up through the draw-up section of the wick.

On the other hand, as regards the opposite case of a high pressure arising in the fuel tank, attention must be given to ensuring that liquid fuel stored in the fuel tank does not leak to the exterior through fuel passages formed by the wick, particularly to ensure that liquid fuel leakage does not occur in a pocketable fire-lighting device or the like.

Thus, when a difference arises between the internal pressure of the fuel tank and the external pressure owing to the aforesaid depletion of fuel with use or to a change in the surrounding temperature or the ambient pressure, the liquid fuel burner is liable to become inconvenient to use, i.e., to experience leakage of liquid fuel through the wick when the internal pressure of the fuel tank becomes high and to experience lighting (ignition) failure when the fuel tank internal pressure becomes so low as to allow external air to be sucked in through the wick.

Moreover, suppression of evaporative dispersion of liquid fuel from the wick of a burner using one of the aforesaid wicks is important for increasing service life (number of uses), while it is also preferable to make the overall configuration compact.

Vaporization from the wick is prevented by covering the wick portion alone or the whole upper surface portion including the wick with a cap to seal the wick and suppress vaporization during non-use periods. Completely reliable sealing is, however, hard to achieve. This is particularly true when covering is effected by causing the cap to swing along an upward arc, because the need to provide the seal portion in conformity with the locus of rotation results in increased spacing between the wick and other components such as the igniter, making it difficult to secure sealing property and compact configuration.

Particularly when a striker wheel is used for the igniter, separation between the wick and the striker wheel degrades igniting performance and lowers the reliability of the product.

In view of these circumstances, the invention is directed to providing a liquid fuel burner enabling rapid elimination of pressure difference between the interior and exterior of the fuel tank.

DISCLOSURE OF THE INVENTION

This invention overcomes the foregoing problems by providing a liquid fuel burner comprising a wick for burning liquid fuel drawn up therethrough by capillarity from a fuel tank, characterized in that it is provided at a location apart from fuel passages of the wick with an air passage communicating the interior of the fuel tank with external air at least during burning.

Since the invention liquid fuel burner uses liquid fuel as a matter operating principle, it does not need a pressure-resistant structure or a valve system and can therefore be of simplified structure. Moreover, the invention enables low-cost mass production of a burner exhibiting stable burning characteristics with minimal change in flame length with temperature change. Owing to the provision of the air passage communicating the interior of the fuel tank with the exterior air at a location apart from the fuel passages of the wick, moreover, decrease in fuel tank internal pressure with depletion of the liquid fuel in the fuel tank is offset by inflow of external air through the air passage, thereby eliminating pressure difference between the interior and exterior of the fuel tank. After the flame-producing section of the wick has been lit, therefore, an amount of liquid fuel equal to that contained in the wick and consumed by burning can be quickly replenished with liquid fuel from the fuel tank through the fuel passages of the draw-up section, which is not in a reduced pressure state. The fuel supply response is therefore improved to provide a stable burning state immediately after lighting.

Another aspect of the invention provides a liquid fuel burner comprising a wick for burning liquid fuel drawn up therethrough by capillarity from a fuel tank, characterized in that the wick is divided into two segments at least one of which is movable to contact and separate from the other, fuel being supplied from one segment to the other during contact and fuel supply being cut off during separation to limit burning period, and an air passage communicating the interior of the fuel tank with external air at least during burning is provided at a location apart from fuel passages of the wick.

Since separation of the segments cuts off the supply of fuel, a function of automatic extinguishment after a prescribed period of burning can be easily obtained with high reliability. Owing to the provision of the air passage communicating the interior of the fuel tank with the exterior air at a location apart from the fuel passages of the wick, pressure difference between the interior and exterior of the fuel tank can be rapidly eliminated to further enhance the reliability and stability of the burning period limiting function.

The liquid fuel burner according to the invention can comprise a closure cap for preventing fuel vaporization. This provides a sealing effect that suppresses evaporative dispersion of liquid fuel from the wick and the air passage and thereby extends the service life.

When an openable/closable anti-vaporization closure cap for sealing the wick flame-producing section is provided, the opening of the air passage to the external air is preferably formed to communicate with the space sealed by the closure cap in its closed state or to be closed by the sealing end of the closure cap in its closed state. Alternatively, an air passage closure member can be provided on the closure cap or ganged therewith to open/close the opening of the air passage to the external air simultaneously with the operation of the closure cap to open/close the flame-producing section of the wick. By such means, when the closure cap is in the closed state the air passage is also closed to effect prevention of liquid fuel vaporization, while during use with the closure cap open, the air passage is also opened to produce an effect of equilibrating the internal pressure of the fuel tank and the external pressure.

The air passage can be constituted as a gap along a wick holder provided to surround the outer periphery of the wick or as a groove formed in the inner surface of the wick holder. In can also be constituted by disposing a capillary tube along the wick or as a groove formed in the wick. Since such an air passage situated near the wick enables rapid elimination of pressure differentials between the fuel tank interior and exterior produced by changes in the ambient temperature or ambient pressure of the burner, leakage of liquid fuel and intake of external air through the fuel passages in the wick can be reliably prevented to forestall inconvenience during use.

Another aspect of the invention provides a liquid fuel burner characterized in comprising a wick provided on an upper wall portion of a fuel tank for holding liquid fuel and adapted to burn liquid fuel drawn up therethrough by capillarity from the fuel tank, an igniter for lighting the wick, an air passage communicating the interior of the fuel tank with external air at least during burning provided at a location apart from fuel passages of the wick, a cap for sealing an upper end of the fuel tank from which the wick and the igniter protrude by traversing a straight path along the direction of wick protrusion to fit over and cover the upper end of the fuel tank from above, and an O-ring, packing or other such seal member interposed at a sealing portion of the cap.

With this configuration, the cap can seal the upper end of the fuel tank from which the wick and the igniter protrude by traversing a straight path along the direction of wick protrusion to fit over and cover the upper end of the fuel tank from above. Since this simplifies the seal structure and offers a high degree of freedom regarding component spacing, it enables a more compact structure.

The cap can be internally equipped with an inner cap that is operated in unison with an operation for attaching/detaching the cap to/from the fuel tank to seal the wick through an interposed seal member. Since this configuration reduces the volume of the sealed space, it exhibits an excellent liquid fuel vaporization suppressing effect.

When the cap is internally provided with the inner cap, the inner cap is preferably guided to seal the wick by a peripheral fitting portion between the fuel tank and the cap during attachment/detachment of the cap to/from the fuel tank. This configuration enables good performance of the attachment/detachment operation with respect to the internal fitting portion, thereby facilitating securement of reliable sealing.

The inner cap can be attached to the cap through an elastic member that enables sealing of the wick with the seal member maintained under pressure. Since this configuration lowers the degree of dimensional precision required during fabrication, it facilitates production. Preferably in this configuration, either the inner cap is disposed eccentrically relative to the cap and a surface orthogonal to a direction of attachment/detachment at the peripheral fitting portion of the cap and the fuel tank is shaped to have radial asymmetric directionality or the inner cap is disposed concentrically relative to the cap and a surface orthogonal to the direction of attachment/detachment at the peripheral fitting portion of the cap and the fuel tank is shaped to have radial symmetry. This configuration improves ease of use by enabling ready attachment in accordance with the shape of the cap without need for attention to the position of the inner cap.

The risk of dropping or losing the cap can be eliminated by providing a connecting member for connecting the fuel tank with the cap detached therefrom.

The upper end of the fuel tank to which the cap is detachably attached can be provided about at least part of its outer periphery with an upwardly projecting peripheral wall. This peripheral wall can be formed with an inclined upper edge or be provided with air holes to serve as a windshield, and can also function as a guide member for the cap.

The cap can be provided with a guide member for slidingly guiding it in the attachment/detachment direction relative to the fuel tank and can be further made movable to a retracted position not over the wick and the igniter after it has moved to or beyond a position where it disengages from the fuel tank. This configuration improves the cap opening and closing operability while ensuring good sealing and compact size.

The guide member can be constituted as a shaft member for guiding the cap in the attachment/detachment direction relative to the fuel tank to a position where a lower end of the cap is higher than tip portions of the wick and the igniter, the shaft member be connected to the cap at a point apart from its center, and the cap be adapted to rotate to the retracted position about the shaft member. As another configuration, the guide member can be provided midway with a hinge and the cap can be made movable to the retracted position by swinging it in an upward arc about the hinge. These configurations are particularly superior in the point that the cap does not become a hindrance during ignition and use. Energizing means is preferably providing for biasing the cap from the slid position on the guide member to the retracted position.

When the cap seals the upper end of the fuel tank from which the wick and the igniter protrude by traversing a straight path along the direction of wick protrusion to fit over and cover the upper end of the fuel tank from above, the wick can be divided into two segments at least one of which is movable to contact and separate from the other, fuel being supplied from one segment to the other during contact and fuel supply being cut off during separation.

As the liquid fuel there can be used an alcohol fuel, for example, one having a lower monovalent alcohol, namely, methyl alcohol, ethyl alcohol or propyl alcohol, as its main component and having mixed therewith a saturated hydrocarbon such as hexane or heptane for coloring the flame, or, otherwise, a benzine hydrocarbon or a petroleum hydrocarbon or the like.

As the wick there can be used one whose flame-producing section and draw-up section are formed of different materials as in the embodiments set out below or, otherwise, one whose flame-producing section and draw-up section are integrally formed of the same material.

BEST MODE FOR CARRYING OUT THE INVENTION

Embodiments of the liquid fuel burner according to the invention will be explained in the following with reference to the drawings.

<First Embodiment>

Figure 1:
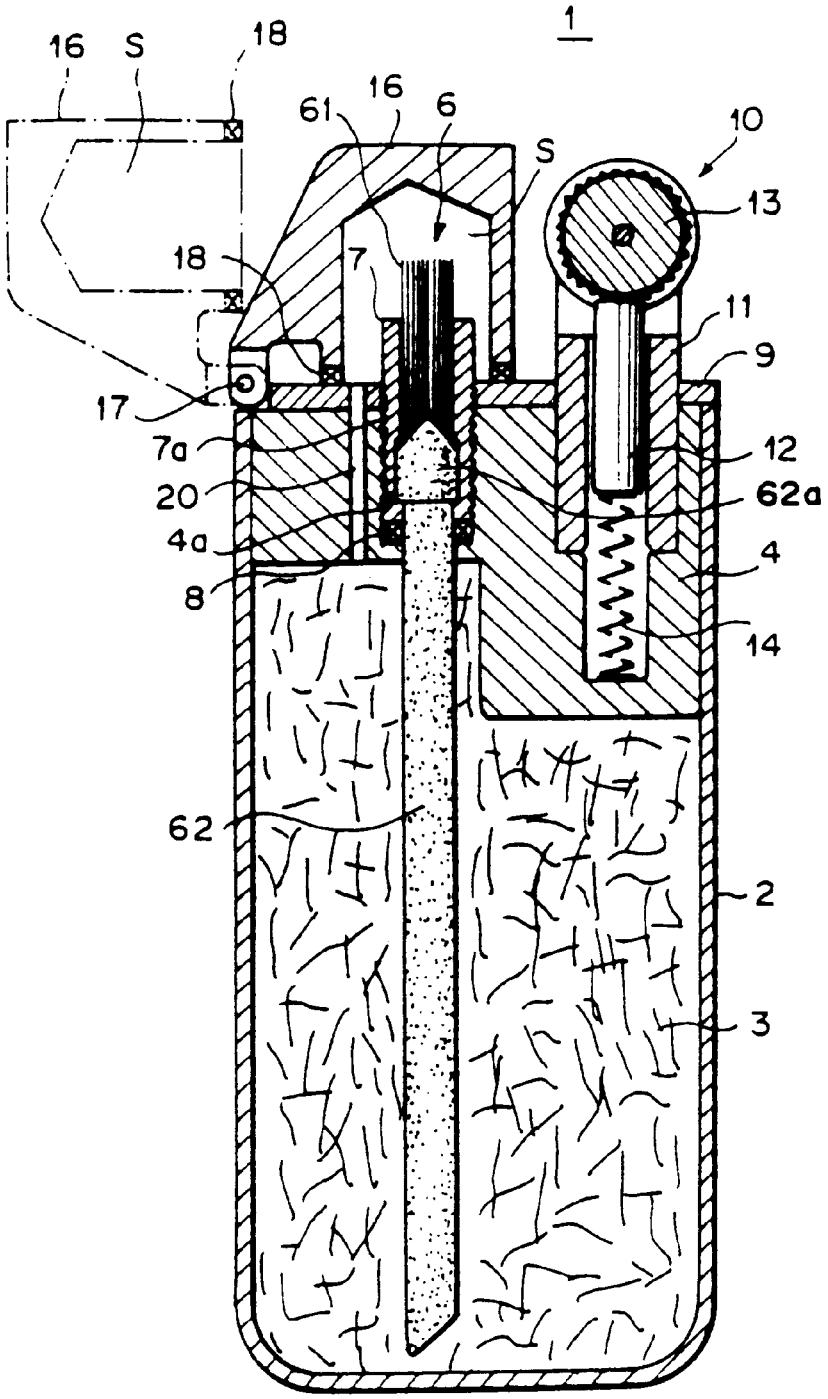
FIG. 1 is a schematic sectional view of a lighter as an example of a liquid fuel burner that is a first embodiment of the invention.

FIG. 1 schematically shows the sectional structure of a disposable cigarette lighter as an example of a liquid fuel burner.

The lighter, designated by reference numeral 1, has a fuel tank 2 of cylindrical shape with closed bottom. Fiber material 3 (stuffing) is inserted into the interior of the fuel tank 2 and a top cover 4 is fixed to the upper portion of the fuel tank 2 to constitute a sealed structure that contains, but cannot be refilled with, liquid fuel.

The fuel tank 2 is, for example, provided as a shaped article made of polypropylene with an inner volume of 5 $cm^3$. The fiber material 3 is polypropylene fiber of a thickness of 1–2 denier compacted in the fuel tank 2 to a density of 0.1 $g/cm^3$. 4 g of liquid fuel, a mixture of 95 wt % ethyl alcohol and 5 wt % n-hexane, is poured and impregnated into this fiber material 3 for storage therein.

A wick 6 retained by a wick holder 7 is installed to pass vertically through the top cover 4 into the fuel tank 2. The wick 6 is formed separately of different materials at an upper flame-producing section 61 and a lower draw-up section 62 and the two are joined by the cylindrical metal wick holder 7 with the lower end portion of the flame-producing section 61 and the upper end portion of the draw-up section 62 in a contacted state.

The wick holder 7, which is provided on its outer periphery with a fastening thread 7*a,* is screwed into a threaded hole 4*a* of the top cover 4 of the fuel tank 2 to sandwich a seal ring 8 at the bottom and be fixed in place. A face plate 9 is provided on the upper surface of the top cover 4.

The lower end portion of the draw-up section 62 of the wick 6 contacts the fiber material 3 in the fuel tank 2 and draws up the liquid fuel impregnated in the fiber material 3 utilizing capillarity. The flame-producing section 61 of the wick 6 is lit to burn and generate a flame.

The flame-producing section 61 is composed of bundled glass fibers. For example, glass fibers having a thickness of 6 $\mu$m, a fiber density (metsuke amount) of 150 $mg/cm^3$, an outer diameter of 3 mm and a length of 10 mm are inserted into the wick holder 7 to protrude to a length of 3 mm from the tip portion of the wick holder 7.

The draw-up section 62, formed as a rod having a large-diameter head portion by molding and sintering polyethylene powder, has its head portion inserted into the lower portion of the wick holder 7 to make contact with the lower end of the flame-producing section 61, and the lower end portion of the wick holder 7 is caulked in this state, whereby the flame-producing section 61 and the draw-up section 62 are integrally joined to constitute the wick 6.

The draw-up section 62 is, for example, obtained by placing in a mold polyethylene powder that is a mixture of particles of 70–200 mesh with an average particle size of 140 mesh and sintering it for 10 minutes at 170° C. The head portion 62*a* is formed to an outer diameter of 4.2 mm and a length of 3 mm and the lower leg portion to an outer diameter of 4 mm and a length of 37 mm.

The amount of fuel consumed by the wick 6 when lit, the flame shape and the flame length are determined by the thickness, number and length of the glass fibers of the flame-producing section 61. In contrast, the formation pattern of the gaps in the draw-up section 62, which determines the fuel draw-up and supply characteristics, differs with the thickness, the particle diameter of the sintered polyethylene, the sintered density and the like of the draw-up section 62. The head portion of the draw-up section 62, being formed to a large diameter to have a large volume, constitutes a fuel reservoir for holding the liquid fuel. Burning stabilization is obtained by this fuel reservoir.

An igniter 10 is installed on the top cover 4 to face the tip of the flame-producing section 61 of the wick 6. A bracket 11 of the igniter 10 fixed to the top cover 4 has a flint 12 inserted therein to be vertically movable and a rotating striker wheel 13 is provided on the upper end of the bracket 11. The tip of the flint 12 is pressed onto the peripheral surface of the rotating striker wheel 13 by the force of a flint pusher spring 14 and rotation of the rotating striker wheel 13 causes sparks to fly toward the wick 6.

A closure cap 16 for evaporation prevention is provided to openably/closably cover the flame-producing section 61 of the wick 6 together with the protruding portion of the wick holder 7. This closure cap 16 is rotatably pivoted by a pin 17 at one end portion of the upper surface of the top cover 4 of the fuel tank 2. The closure cap 16 is formed to have an internal U-shaped sealed space S and the sealing end for pressure contact is provided with a seal member 18.

An air passage 20 is opened in the lighter 1 of the foregoing structure by boring a hole through the top cover 4 and the face plate 9 to communicate the interior of the fuel tank 2 with the external air. The opening of the air passage 20 on the external air side is situated at a point inward of the seal member 18 of the closed closure cap 16 so as to communicate with the sealed space S. The diameter of the air passage 20 is, for example, 0.5 mm–2.0 mm.

The presence of the air passage 20 enables the interior space of the fuel tank 2 to communicate with the external air while the closure cap 16 is open. When the tip of the wick 6 is lit by the igniter 10 and burning commences, liquid fuel is supplied from the draw-up section 62 to the flame-producing section 61 through the fuel passages of the wick 6 in an amount equal to the amount consumed at the flame-producing section 61 by the burning. Liquid fuel is thus successively drawn up from the fuel tank 2. Ordinarily the reduction in the internal pressure of the fuel tank 2 this produces owing to the diminishing volume of the liquid fuel in the fuel tank 2 tends to impede fuel draw-up. However, since any pressure differential that arises is eliminated by a proportional inflow of external air through the air passage 20, unimpeded, rapid supply of fuel to the flame-producing section 61 can be obtained to ensure prompt stabilization of the flame length from the initial burning stage.

When the internal pressure of the fuel tank 2 rises above the external air pressure because of, for instance, an increase in the temperature of the lighter 1 or a decrease in the external air pressure, internal air is discharged through the air passage 20. Therefore, liquid fuel retained in the wick 6 does not leak out through the flame-producing section 61. Conversely, when the internal pressure of the fuel tank 2 falls below the external air pressure because of, for instance, a decrease in the temperature of the lighter 1 or an increase in the external air pressure, external air flows in through the air passage 20. Since liquid fuel retained in the wick 6 is therefore not forced back by inflowing external air, no fuel deficiency arises at the flame-producing section 61.

When the closure cap 16 is shut, escape of vaporized liquid fuel through the air passage 20 is suppressed because the exterior opening of the air passage 20 communicates with the sealed space S.

The lighter 1 according to the First Embodiment was subjected to tests under use conditions to ascertain the effect of forming the air passage 20. The results are set out in a later section.

<Second Embodiment>

Figure 2:
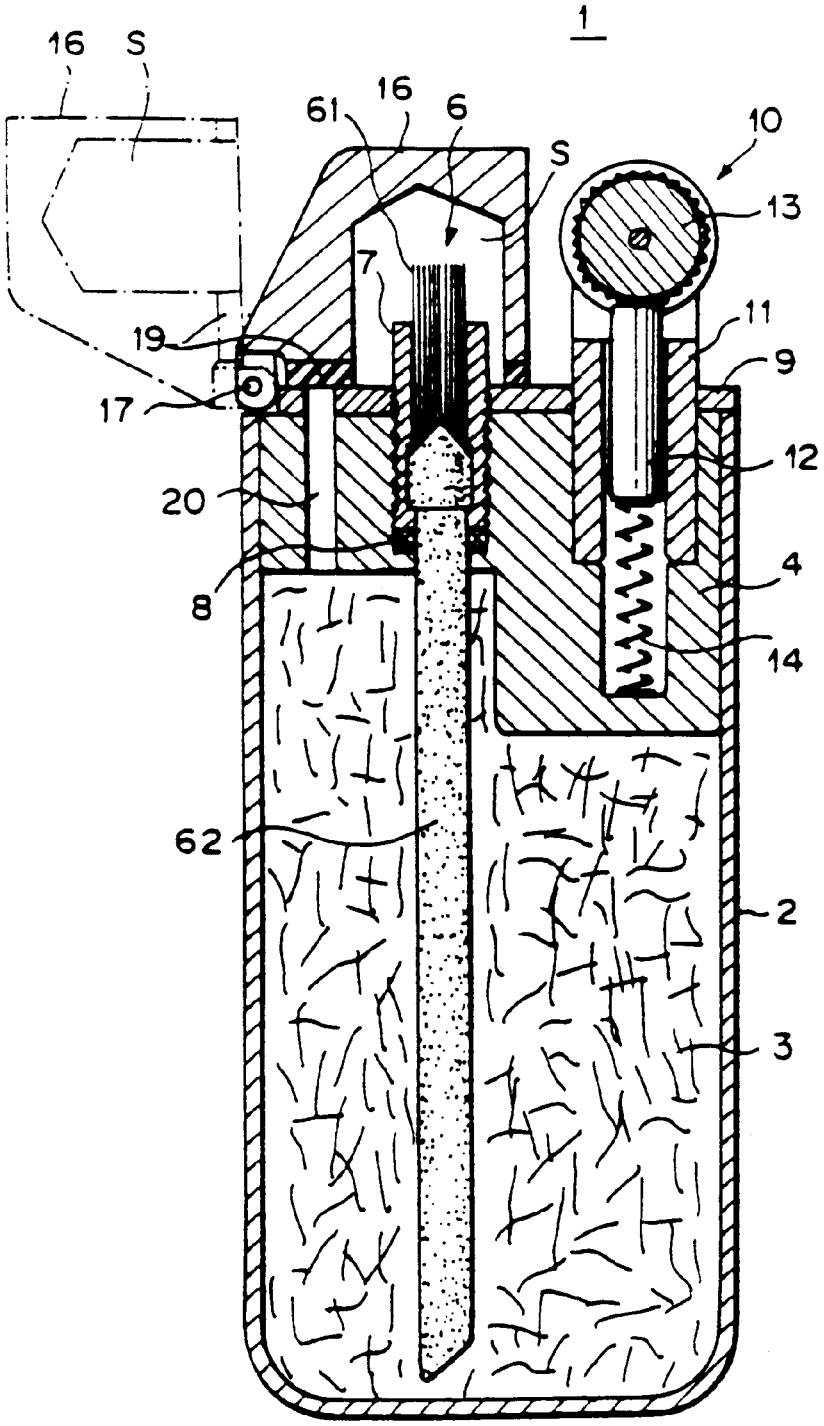
FIG. 2 is a schematic sectional view of a lighter that is a second embodiment.

As shown in FIG. 2, the lighter 1 of this embodiment resembles the preceding embodiment in the configuration of the wick 6 but differs therefrom in the relationship between the air passage 20 and the closure cap 16.

In this embodiment, the sealing end of the closure cap 16 has a seal member 19 providing a broad seal surface and the air passage 20 is bored so that its exterior opening faces the seal member 19. In other words, the air passage 20 communicating the interior of the fuel tank 2 with the external air is provided to be directly opened and closed in conjunction with the opening and closing operation of the closure cap 16. The other portions are formed like those of the First Embodiment. The same constituent elements are assigned the same references symbols and explanation thereof is omitted.

Like the First Embodiment, this embodiment also exhibits stable burning characteristics, while still more reliably preventing leakage of liquid fuel and vaporization through the air passage 20 when the closure cap 16 is shut.

<Third Embodiment>

Figure 3:
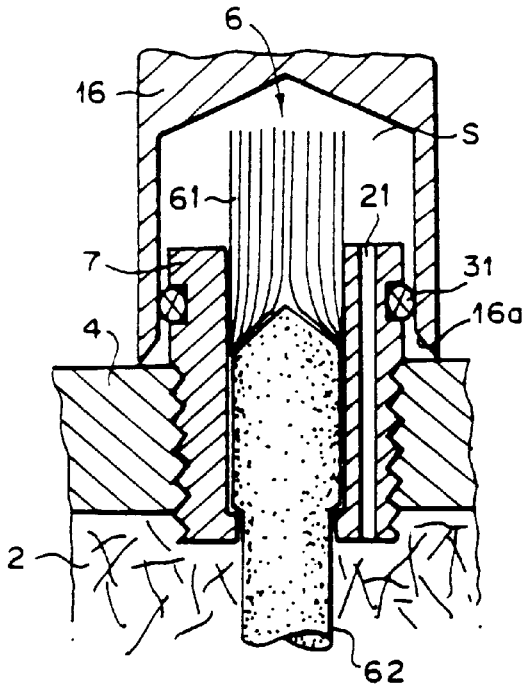
FIG. 3 is a sectional view of an essential portion of a lighter that is a third embodiment.

An essential structural feature of the lighter of this embodiment is shown in FIG. 3. An air passage 21 communicating the interior of the fuel tank 2 and the external air is formed through in the wick holder 7 fitted around the wick 6, so as run parallel to the wick 6.

An O-ring 31 for sealing is fitted around the tip portion of the wick holder 7 and sealing of the flame-producing section 61 of the wick 6 and the opening of the air passage 21 is established by pressure contact between the inner peripheral surface of a sealing end 16*a* of the closure cap 16 and the O-ring 31. The sealing end 16*a* of the closure cap 16 is beveled for easy fitting over the O-ring 31.

<Fourth Embodiment>

Figure 4:
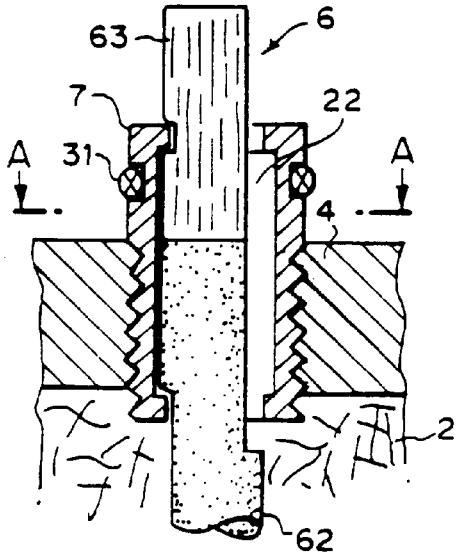
FIG. 4 is a sectional view of an essential portion of a lighter that is a fourth embodiment.
Figure 5:
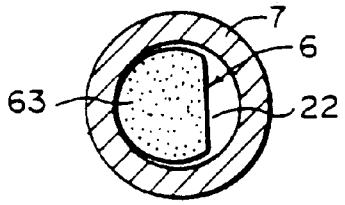
FIG. 5 is a sectional view taken along line A—A in FIG. 4.

An essential structural feature of the lighter of this embodiment is shown in FIG. 4. A sectional view taken along line A—A of FIG. 4 is shown in FIG. 5. An air passage 22 communicating the interior of the fuel tank 2 with the exterior is formed by cutting away a portion of the wick 6 to establish a groove-like space between the wick 6 and the wick holder 7.

The flame-producing section 63 of the wick 6 of this embodiment is not made of glass fibers but is a porous ceramic sintered body formed in round rod-like shape and contains continuous bubbles (capillary passages) inside. The upper portion of this flame-producing section 63 is mounted to protrude from the tip of the wick holder 7 by a prescribed amount (e.g., 3 mm). This protrusion amount, the diameter and the like determine the size of the flame. For instance, it is constituted to have an outer diameter of 3.0 mm and a length of 10 mm.

On the other hand, the draw-up section 62 whose tip portion abuts on the lower end portion of the flame-producing section 63 is again a porous material made of a sintered body of polyethylene powder and formed into round rod-like shape. An edge portion of the draw-up section 62 is removed in the sectional shape of a circle segment from the tip portion of the flame-producing section 63 to a point below the wick holder 7 so as to form the air passage 22 between the wick 6 and the inner surface of the cylindrical wick holder 7. The characteristics of this air passage are the same as those of the preceding embodiments.

<Fifth Embodiment>

Figure 6:
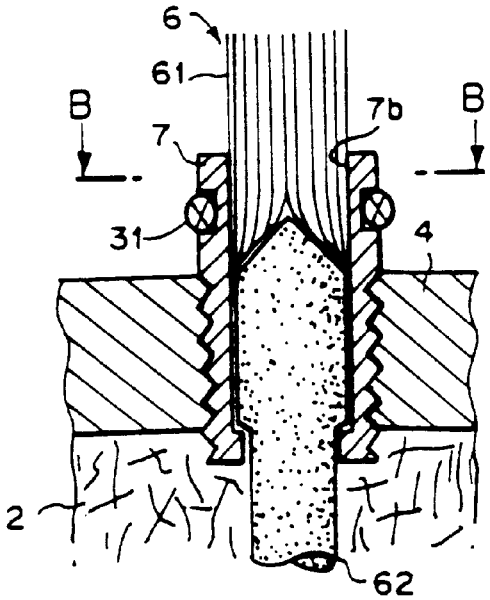
FIG. 6 is a sectional view of an essential portion of a lighter that is a fifth embodiment.
Figure 7:
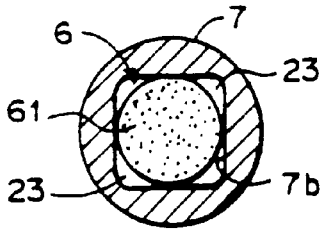
FIG. 7 is a sectional view taken along line B—B in FIG. 6.

An essential structural feature of the lighter of this embodiment is shown in FIG. 6. A sectional view taken along line B—B of FIG. 6 is shown in FIG. 7. Air passages 23 communicating the interior of the fuel tank 2 with the exterior are formed by spaces between the wick 6 and the wick holder 7.

Specifically, the flame-producing section 61 and the upper portion of draw-up section 62 of the wick 6 are formed to have circular cross-sections and the inner hole 7*b* of the wick holder 7 is formed to have a rectangular cross-section. Approximately triangular spaces are therefore defined to pass vertically at the four corners between the two. These spaces constitute the air passages 23 communicating the interior of the fuel tank 2 with the exterior. The other portions are formed like those of the Third Embodiment.

<Sixth Embodiment>

Figure 8:
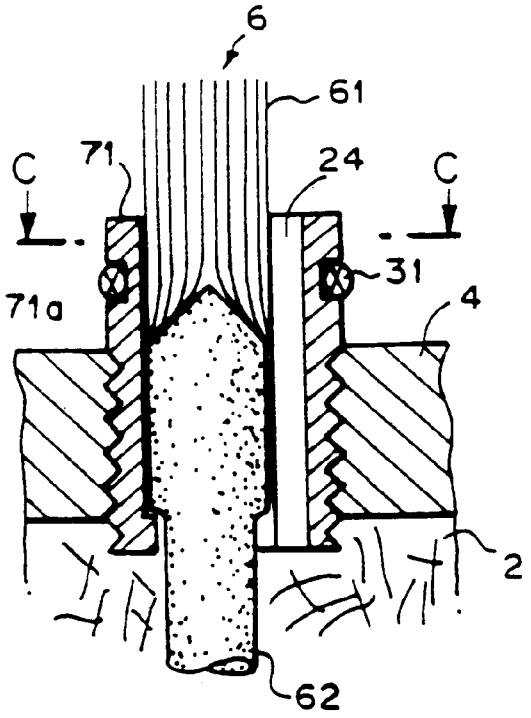
FIG. 8 is a sectional view of an essential portion of a lighter that is a sixth embodiment.
Figure 9:
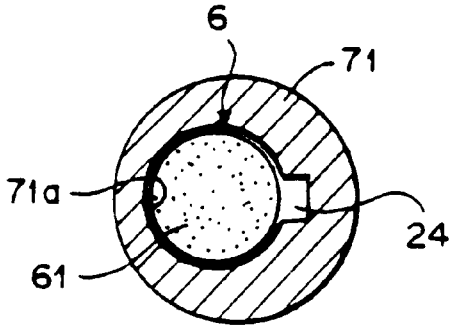
FIG. 9 is a sectional view taken along line C—C in FIG. 8.

An essential structural feature of the lighter of this embodiment is shown in FIG. 8. A sectional view taken along line C—C of FIG. 8 is shown in FIG. 9. An air passage 24 communicating the interior of the fuel tank 2 with the exterior is formed by a groove provided in the inner hole 71*a* of a wick holder 71.

Specifically, a portion of the inner surface of the inner hole 71*a* of the wick holder 71 for holding the wick 6 is formed with a vertical groove extending over the full length of the wick holder 71 in the axial direction. When the wick 6 is inserted into the inner hole 71*a*, the air passage 24 is defined to run parallel to the peripheral surface of the wick 6. The inner hole 71*a* for holding the wick 6 is formed eccentrically in the wick holder 71 and the air passage 24 is provided in the thick wall portion. The other portions are formed like those of the Third Embodiment.

<Seventh Embodiment>

Figure 10:
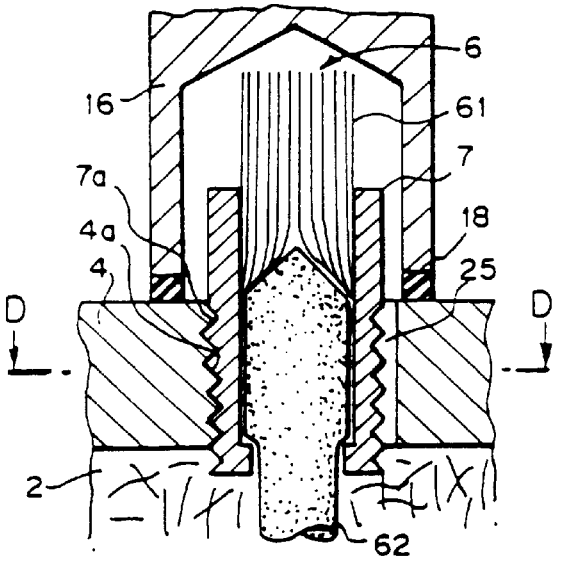
FIG. 10 is a sectional view of an essential portion of a lighter that is a seventh embodiment.
Figure 11:
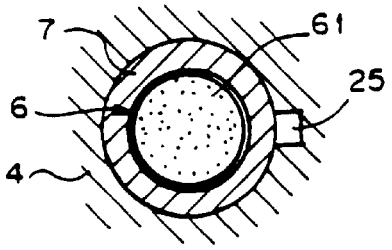
FIG. 11 is a sectional view taken along line D—D in FIG. 10.

An essential structural feature of the lighter of this embodiment is shown in FIG. 10. A sectional view taken along line D—D of FIG. 10 is shown in FIG. 11. An air passage 25 communicating the interior of the fuel tank 2 with the exterior is formed by a groove provided between the wick holder 7 and the top cover 4 of the fuel tank 2.

Specifically, a threaded hole 4*a* is formed through the top cover 4 of the fuel tank 2 and a fastening thread 7*a* formed at the lower peripheral portion of the wick holder 7 for holding the wick 6 therein is screwed into the threaded hole 4*a*. A portion of the inner surface of the threaded hole 4*a* is formed over its full length with a vertical groove. The air passage 25 communicating the fuel tank 2 with the exterior is constituted by this vertical groove. The other portions are formed like those of the First Embodiment.

<Eighth Embodiment>

Figure 12:
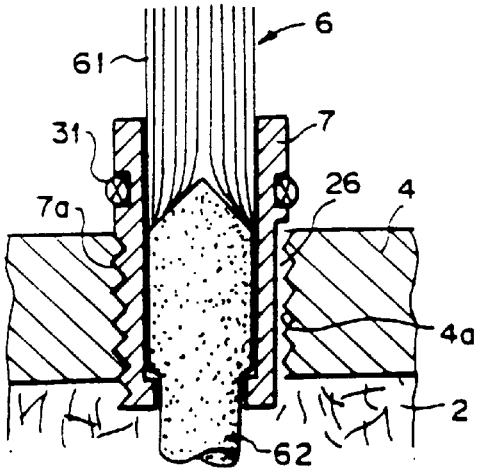
FIG. 12 is a sectional view of an essential portion of a lighter that is an eighth embodiment.

An essential structural feature of the lighter of this embodiment is shown in FIG. 12. An air passage 26 communicating the interior of the fuel tank 2 with the exterior is formed by a vertical groove provided in the outer periphery of the wick holder 7.

Specifically, a portion of the fastening thread 7*a* cut around lower end of the wick holder 7 is formed with a vertical groove to a length greater than the thickness of the top cover 4 of the fuel tank 2 so as to define the air passage 26 between the inner and outer sides of the top cover 4. The other portions are formed like those of the Seventh Embodiment.

<Ninth Embodiment>

Figure 13:
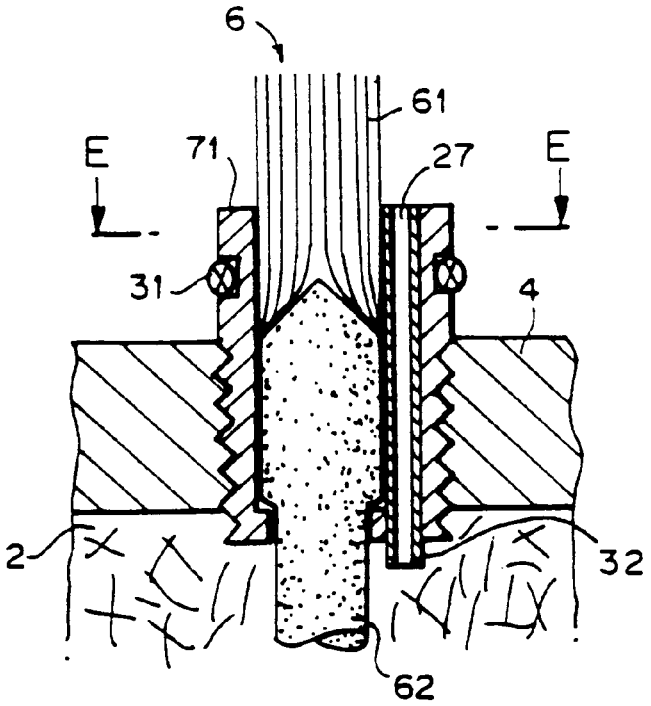
FIG. 13 is a sectional view of an essential portion of a lighter that is a ninth embodiment.
Figure 14:
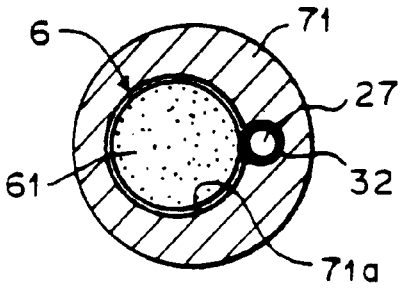
FIG. 14 is a sectional view taken along line E—E in FIG. 13.

An essential structural feature of the lighter of this embodiment is shown in FIG. 13. A sectional view taken along line E—E of FIG. 13 is shown in FIG. 14. An air passage 27 communicating the interior of the fuel tank 2 with the exterior is formed by a capillary tube installed parallel to the wick 6.

Specifically, a capillary tube 32 is implanted vertically at the side of and in parallel with the inner hole 71*a* of the wick holder 71 of the wick 6. The inner channel of the capillary tube 32 constitutes the air passage 27. The inner hole 71*a* for holding the wick 6 is formed eccentrically in the wick holder 71 and the air passage 27 is provided in the thick wall portion. The other portions are formed like those of the Third Embodiment.

<Tenth Embodiment>

Figure 15:
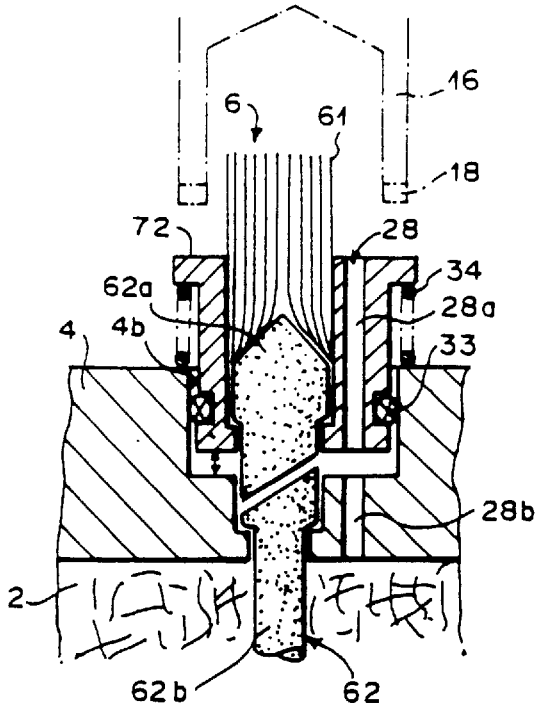
FIG. 15 is a sectional view of an essential portion of a lighter that is a tenth embodiment.

An essential structural feature of the lighter of this embodiment is shown in FIG. 15. In this embodiment the wick 6 is divided into two segments to enable rationed burning.

The wick 6 is divided into two segments by splitting the draw-up section 62 into a lower draw-up segment 62*b* and an upper draw-up segment 62*a* which is capable of sliding vertically together with the glass fiber flame-producing section 61 to bring its lower end into and out of contact with the upper end of the lower draw-up segment 62*b*. Specifically, the flame-producing section 61 and the upper draw-up segment 62*a* are retained in a cylindrical wick holder 72 and the wick holder 72 is supported in a slide hole 4*b* in the top cover 4 of the fuel tank 2 to be vertically slidable. On the other hand, the lower draw-up segment 62*b* has its upper end fixed to the top cover 4 and its lower end inserted into the fuel tank 2. The upper draw-up segment 62*a* constitutes a fuel reservoir of a volume capable of retaining the quantity of fuel required for a prescribed period of burning at the flame-producing section 61.

An air passage 28 communicating the interior of the fuel tank 2 with the external air is formed of a first air passage segment 28*a* passing vertically through the wick holder 72 and a second air passage segment 28*b* formed to pass through the floor of the slide hole 4*b* of the top cover 4 to communicate with the first air passage segment 28*a*.

The wick holder 72 is fitted with a seal ring 33 and accommodated in the slide hole 4*b* and is biased in the separating direction (upward) by a coil spring 34. The coil spring 34 is inserted between the upper surface of the top cover 4 and the upper end of the wick holder 72. When the flame-producing section 61 and the upper draw-up segment 62*a* move upward under the force of the coil spring 34, the lower end of the upper draw-up segment 62*a* separates from the upper end of the lower draw-up segment 62*b* to form a gap between the two segments.

A seal member 18 at the sealing end of an openable/closable closure cap 16 for covering the flame-producing section 61 of the wick 6 is adapted to press the wick holder 72 down by striking on its upper end at a region outward of the opening of the first air passage segment 28*a*. When the closure cap 16 is shut, it presses the wick holder 72 downward against the force of the coil spring 34 to bring the lower end of the upper draw-up segment 62*a* into contact with the upper end of the lower draw-up segment 62*b* and simultaneously covers and seals the air passage 28 of the flame-producing section 61 to prevent escape of vaporized liquid fuel.

Since the upper draw-up segment 62*a* and the lower draw-up segment 62*b* of the wick 6 are thus in contact when the closure cap 16 is closed, a prescribed amount of liquid fuel is supplied to and retained by the flame-producing section 61. When the closure cap 16 is thereafter opened, the wick holder 72 is freed from the downward pressure and moved upward by the coil spring 34 to break the contact with the lower draw-up segment 62*b* and cut off the supply of fuel.

After the flame-producing section 61 is lit, the flame burns utilizing the fuel retained in the flame-producing section 61 and the upper draw-up segment 62*a*. When all of the fuel has been used up, the flame goes out automatically. The foregoing configuration thus constitutes a rationed burning mechanism (automatic extinguishment mechanism). The characteristics imparted by formation of the air passage 28 are the same as those of the First Embodiment.

In this embodiment the draw-up segment 62*a* and the lower draw-up segment 62*b* are formed to have inclined abutting surfaces so as to enlarge the contact area and increase the amount of liquid fuel supplied per unit time.

<Eleventh Embodiment>

Figure 16:
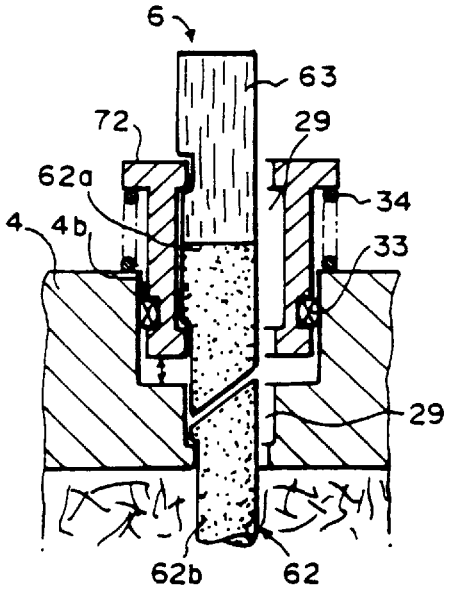
FIG. 16 is a sectional view of an essential portion of a lighter that is an eleventh embodiment.

An essential structural feature of the lighter of this embodiment is shown in FIG. 16. As in the Tenth Embodiment, the wick 6 is divided into two segments to enable rationed burning. An air passage 29 communicating the interior of the fuel tank 2 with the exterior is formed by cutting away a portion of the wick 6 to establish a groove-like space between the wick 6 and the wick holder 72.

The structures of the flame-producing section 63 and draw-up section 62 of the wick 6 and of the air passage 29 are the same as those in the Fourth Embodiment.

The wick 6 is formed in a rod-like shape of a flame-producing section 63 constituted of a porous ceramic sintered body, an upper draw-up segment 62*a* constituted of a sintered body of polyethylene powder, and a lower draw-up segment 62*b*. Edge portions of the upper draw-up segment 62*a* and the lower draw-up segment 62*b* are removed in the sectional shape of a circle segment (see FIG. 5) from the tip portion of the flame-producing section 63 so as to form the air passage 29 between the wick 6 and the inner surface of the cylindrical wick holder 72. The characteristics of this air passage are the same as those of the preceding embodiments.

<Twelfth Embodiment>

Figure 17:
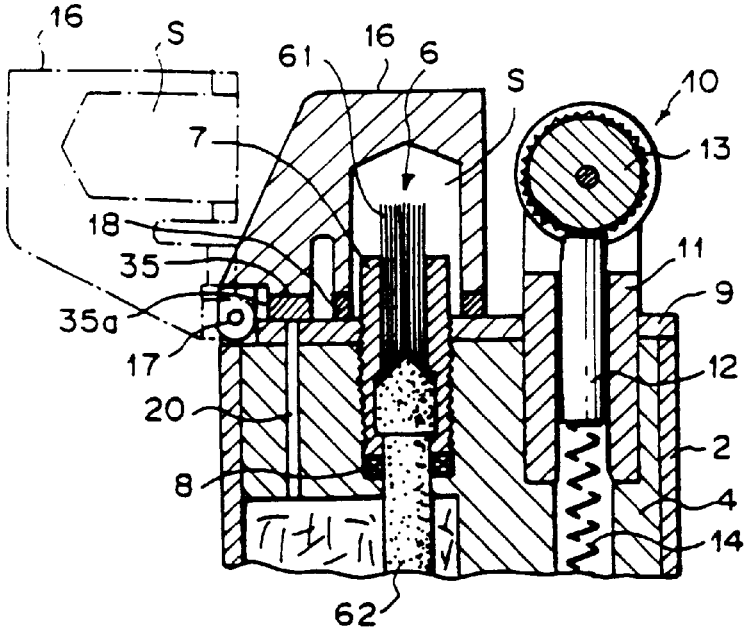
FIG. 17 is a sectional view of an essential portion of a lighter that is a twelfth embodiment.

An essential structural feature of the lighter of this embodiment is shown in FIG. 17. The wick 6 and the air passage 20 are configured like those of the Second Embodiment.

The closure cap 16 of this embodiment is formed to have an internal U-shaped sealed space S for openably/closably covering the flame-producing section 61 of the wick 6 together with the protruding portion of the wick holder 7 and the sealing end thereof is provided with a seal member 18, as in the configuration of the First Embodiment.

The closure cap 16 is further provided with a separate air passage closure member 35 facing the opening of the air passage 20. The tip of the closure member 35 is provided with a seal member 35*a* and the exterior opening of the air passage 20 is directly opened and closed in conjunction with the opening and closing operation of the closure cap 16. The other portions are formed like those of the First Embodiment.

<Thirteenth Embodiment>

Figure 18:
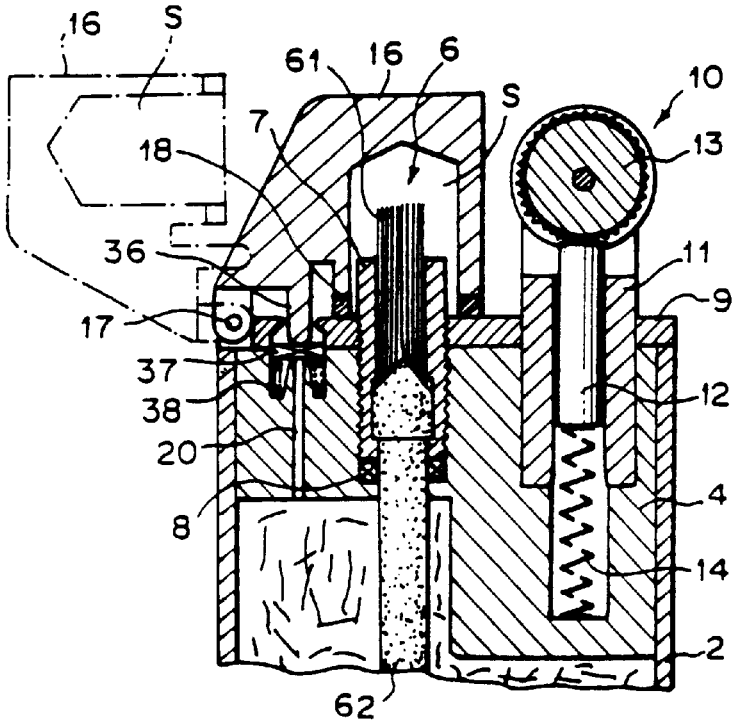
FIG. 18 is a sectional view of an essential portion of a lighter that is a thirteenth embodiment.

An essential structural feature of the lighter of this embodiment is shown in FIG. 18. Another structure for ganging the opening/closing of the air passage 20 with the opening/closing operation of the closure cap 16 is illustrated.

An air passage closure member 37 consisting of a valve body is provided at the exterior opening of an air passage 20 formed through the top cover 4 for opening and closing this opening. The closure member 37 is biased in the closing direction by a spring 38.

On the other hand, the closure cap 16 is formed with a protruding presser 36 capable of applying pressure to the closure member 37. The structure thus gangs the closing operation of the air passage closure member 37 with the closing operation of the closure cap 16.

<Fourteenth Embodiment>

Figure 19:
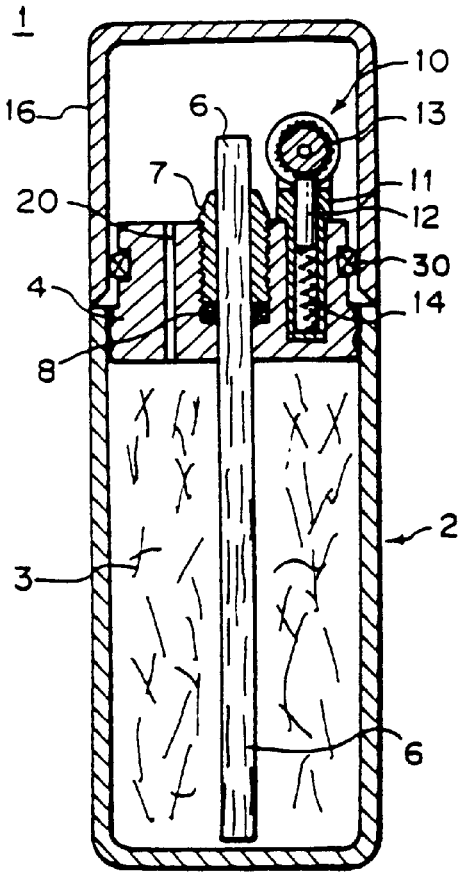
FIG. 19 is a schematic sectional view of a lighter that is a fourteenth embodiment.
Figure 20:
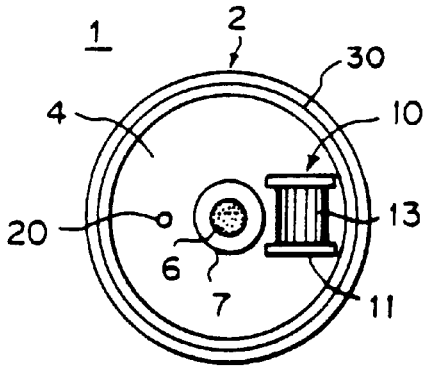
FIG. 20 is a plan view of the lighter of FIG. 19 with the cap detached.

FIG. 19 schematically shows the sectional structure of a disposable cigarette lighter as an example of a liquid fuel burner. FIG. 20 is a plan view with the cap detached.

The wick 6 is integrally formed as, for example, a porous glass sintered body, a porous ceramic sintered body, or a porous material obtained by bundling glass fibers into a rod. As pointed out earlier, it can be formed separately of different materials at the upper flame-producing section and the lower draw-up section.

An evaporation-preventing closure cap 16 for sealing the projecting upper ends of wick 6 and the igniter 10 is provided to be attachable/detachable with respect to the top cover 4 of the fuel tank 2. To effect sealing, the cap 16 traverses a straight path along the direction of wick 6 protrusion, i.e., moves in an attachment/detachment direction parallel to the longitudinal direction of the fuel tank 2 and the axial direction of the wick 6, to fit over and cover the periphery of the upper wall portion 4 from above.

The cap 16 is cylindrical and the inner periphery of its open lower end fits over the outer periphery of the upper end of the top cover 4 to sandwich a seal member 30 (an O-ring) provided on the top cover 4 therebetween. The inner periphery of the lower end of the cap 16 is tapered for easy fitting.

An air passage 20 is provided to pass vertically through the top cover 4 of the fuel tank 2.

The cap 16 is retained in the closed state relative to the fuel tank 2 by the sliding friction between the seal member 30 fitted on the top cover 4 and the inner fitting surface of the cap 16. Other retaining structures can also be configured by adopting a different seal member and appropriate design modifications. For instance, the seal member can be a ring-shaped packing disposed at the outer peripheral portion of the fuel tank 2 contacted by the cap 16 in the axial direction, fitting portions of the outer surface of the top cover 4 and the inner surface of the cap 16 can be provided with a ridge-valley engagement structure as shown, for example, in FIG. 23 described later, and the cap 16 can be retained in a sealed state with pressure applied to a seal member (packing) at its tip portion.

When the cap 16 of this lighter 1 is removed from the fuel tank 2 by pulling it in the attachment/detachment direction, the wick 6 and the igniter 10 are exposed and the igniter 10 can be operated to generate sparks and light the tip of the wick 6. At extinguishment, the flame is blown out and the cap 16 is then fitted onto the fuel tank 2 in the axial direction to seal the wick 6 and suppress escape of vaporized liquid fuel.

<Fifteenth Embodiment>

Figure 21:
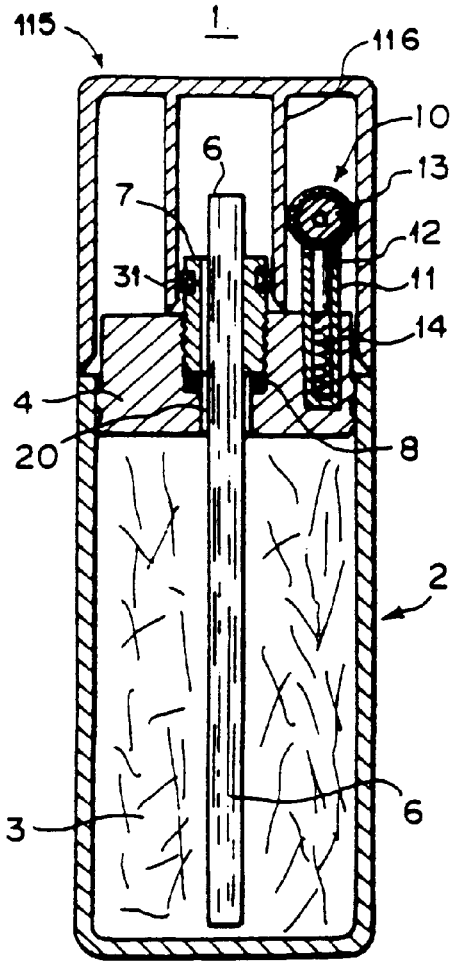
FIG. 21 is a schematic sectional view of a lighter that is a fifteenth embodiment.
Figure 22:
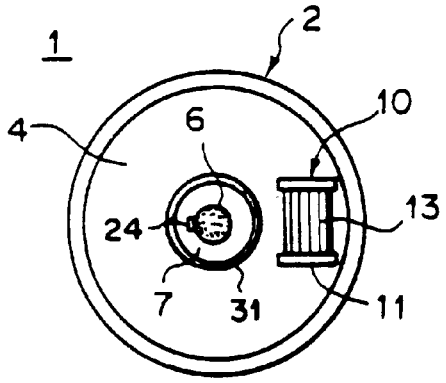
FIG. 22 is a plan view of the lighter of FIG. 21 with the cap detached.

This embodiment of the lighter 1 is shown in FIGS. 21 and 22.

The cap 115 of this embodiment is composed of a cylindrical main portion and a cylindrical inner cap 116 provided inside the main portion to seal only the portion of the wick 6. As in the Fourteenth Embodiment, the wick 6 retained by the wick holder 7 is inserted vertically at the center of the top cover 4 of the fuel tank 2. A sea) member (O-ring) 31 is fitted around the tip portion of the wick holder 7.

The inner cap 116 is disposed at the central portion of the cap 115 to be concentric with the peripheral cylindrical portion thereof. When the cap 115 is fitted over the top cover 4 of the fuel tank 2 from above traversing a straight path in the attachment/detachment direction parallel to the direction of protrusion of the wick 6, the inner cap 116 can be fitted over the outer surface of the wick holder 7 with the seal member 31 interposed therebetween. The inner periphery of the lower end of the inner cap 116 is tapered for easy fitting.

An air passage 20 is formed groove-like in the inner surface of the of the wick holder 7, similarly to the configuration of the Sixth Embodiment, and the opening thereof communicates with the internal sealed space of the inner cap 116 in the closed state.

Although the igniter 10 is mechanically the same as that of the Fourteenth Embodiment, it is sized and positioned to be insertable between the outer wall portion of the cap 115 and the inner cap 116 when the cap 115 is attached. In line with this, a space permitting insertion of the inner cap 116 is formed between wick holder 7 of the wick 6 and the igniter.

The configuration is such that, prior to the inner cap 116 being fitted over the wick holder 7, the outer wall portion of the cap 115 is guided by the peripheral fitting portion at the outer surface of the top cover 4 so that the fitting position is determined to enable easy and reliable fitting. Although the seal member 30 of FIG. 19 is not interposed at the peripheral fitting portion, it can be provided if necessary. The other portions are formed like those of the Fourteenth Embodiment.

<Sixteenth Embodiment>

Figure 23:
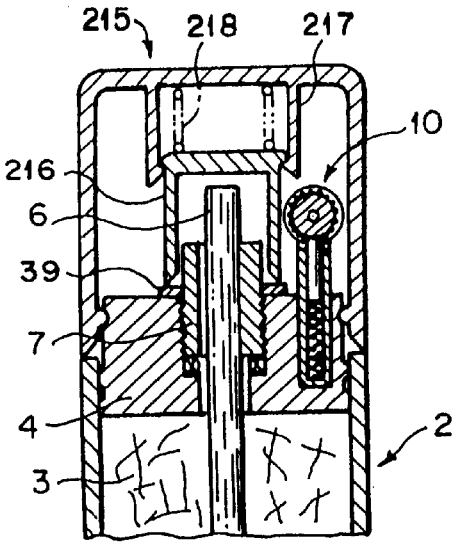
FIG. 23 is a sectional view of an essential portion of a lighter that is a sixteenth embodiment.

An essential structural feature of the lighter of this embodiment is shown in FIG. 23. The configuration of the inner cap 216 of the cap 215 differs from that of the preceding embodiment.

The cap 215 of this embodiment is composed of a cylindrical main portion and the cylindrical inner cap 216 provided inside the main portion to seal only the portion of the wick 6. The inner cap 216 is installed to be slidable in the axial direction and is biased by an elastic body 218.

Specifically, a guide cylinder 217 is provided on the ceiling of the cap 215, and the inner cap 216, a small-diameter cylinder, is retained in the guide cylinder 217 to be capable of axially projecting and retracting. The elastic body (coil spring) 218 is inserted in the guide cylinder 217 under compression so as to bias the inner cap 216 in the projecting direction. A retaining structure is provided for preventing the inner cap 216 from falling out of the guide cylinder 217.

A sealing structure between the inner cap 216 and the wick 6 is constituted by installing a seal member (ring-shaped packing) 39 around the wick holder 7 in contact with the upper surface of the top cover 4 and allowing the force of the elastic body 218 to press the lower end of the inner cap 216 onto the end surface of the seal member 39.

A ridge-valley engagement structure formed at the fitting portion between the outer surface of the top cover 4 and the inner surface of the outer cylindrical portion of the cap 215 prevents the cap from being detached by the force of the elastic body 218. The other portions are formed like those of the Fifteenth Embodiment.

<Seventeenth Embodiment>

Figure 24A:
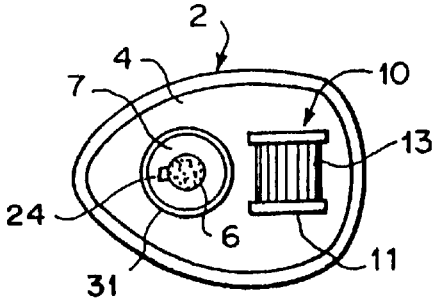
FIG. 24 shows a plan view of a lighter that is a seventeenth embodiment with the cap detached and a sectional view of an essential portion thereof.
Figure 24B:
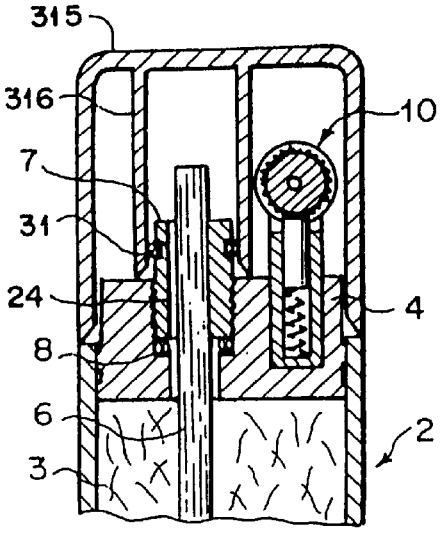

This embodiment of the lighter is shown in FIG. 24. The cap 315 of this embodiment is directional regarding attachment. FIG. 24(A) shows the structure of the top cover 4 of the fuel tank 2 in plan view, with the cap 315 detached. The peripheral fitting portion is elliptical (egg-shaped). Since this shape does not have radial symmetry, the cap 315 is directional regarding attachment. In contrast, the fitting portions in the Fourteenth to Sixteenth Embodiments are circular, i.e., radial symmetrical, and have no directionality regarding attachment.

The wick 6 is disposed eccentrically with respect to the elliptical top cover 4, i.e., is offset to one side from the center of the top cover 4 of the fuel tank 2, thereby securing a large space for installing the igniter 10, whose rotating striker wheel 13 or the like may therefore be of large size. Matched to this, the inner cap 316 inside the cap 315 is also disposed at an offset position. The other portions are formed like those of the Fifteenth Embodiment.

<Eighteenth Embodiment>

Figure 25A:
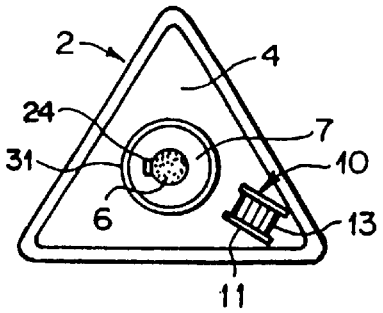
FIGS. 25A and 25B show plan views of two types of lighters according to an eighteenth embodiment with the caps detached.
Figure 25B:
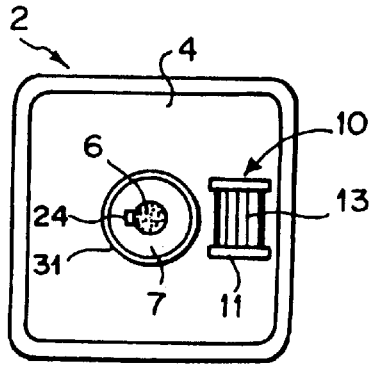

FIGS. 25A and 25B show plan views of the structures of the top cover 4 of the fuel tank 2 of two types of lighters according to this embodiment, with the caps detached. The caps do not have directionality regarding attachment.

The shape of the peripheral fitting portion (shape in a plane perpendicular to the attachment/detachment direction) in FIG. 25(A) is that of a triangle with radial symmetry and the shape of the peripheral fitting portion in FIG. 25(B) is that of a quadrangle with radial symmetry. The cap attached (not shown) is formed to have a triangular or quadrangular shape conforming to the shape of the fuel tank 2.

The wick 6 is disposed at the center of the triangular or quadrangular top cover 4, i.e., at the center of the radially symmetrical profile of the top cover 4 of the fuel tank 2, and, in conformity with this, an inner cap is, like the inner cap 116 in FIG. 21, formed at a center location inside the cap (not shown). Attachment is possible at positions where the fitting portion of the cap is radially symmetrical and though the degree of freedom is lower than with a circular shape, the cap does not have directionality regarding attachment. The other portions are formed like those of the Fifteenth Embodiment.

<Nineteenth Embodiment>

Figure 26:
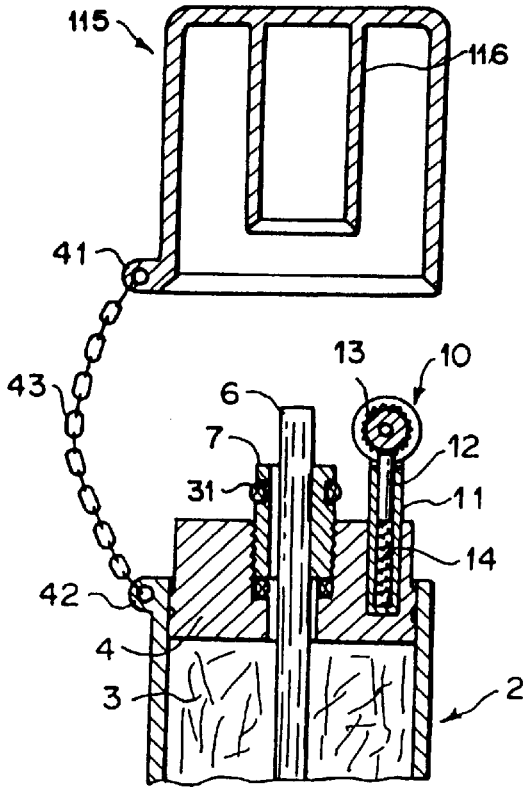
FIG. 26 is a sectional view of an essential portion of a lighter that is a nineteenth embodiment.

An essential structural feature of the lighter of this embodiment is shown in FIG. 26. This lighter 1 has the same basic structure as the Fifteenth Embodiment but is additionally provided with a structure for preventing loss of the cap 115.

Specifically, the cap 115 is provided with a first retainer 41, the fuel tank 2 is provided with a second retainer 42, and the retainers 41 and 42 are lined by a connecting member 43 such as a chain. The other portions are formed like those of the Fifteenth Embodiment.

<Twentieth Embodiment>

Figure 27:
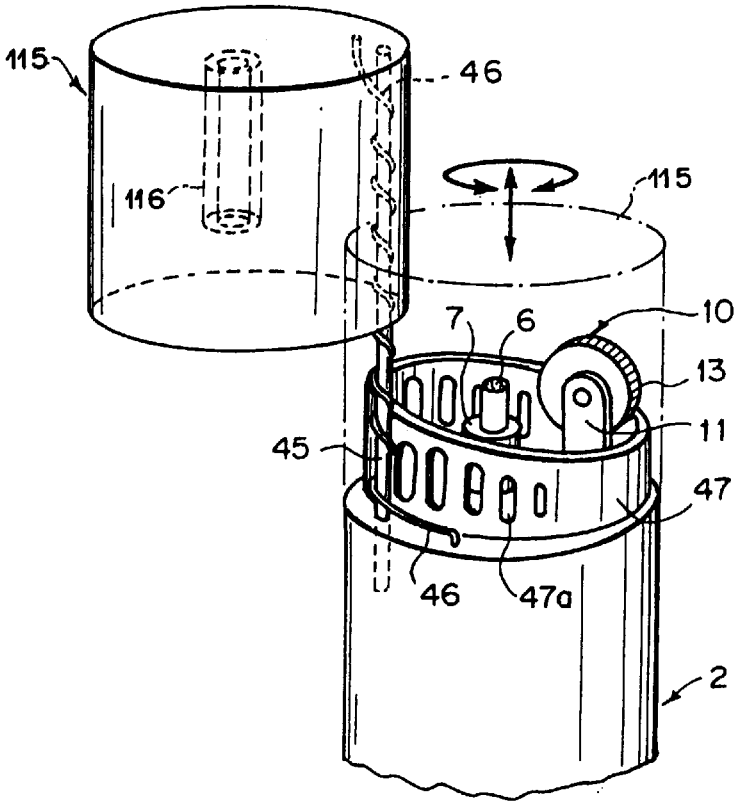
FIG. 27 is a perspective view of an essential portion of a lighter that is a twentieth embodiment.
Figure 28:
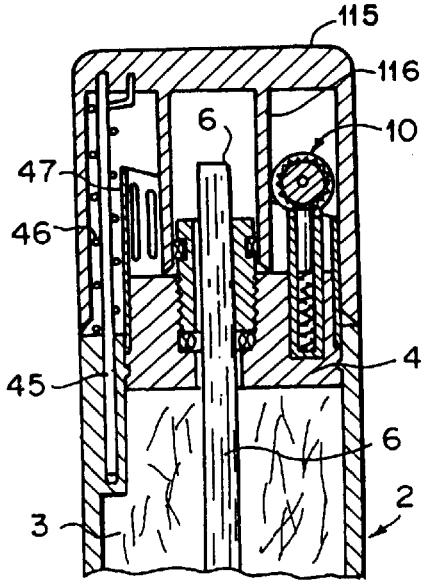
FIG. 28 is a sectional view of an essential portion of FIG. 27.

An essential structural feature of the lighter of this embodiment is shown in FIG. 27. A sectional view of the structure is shown in FIG. 28. In this embodiment, the cap 115 can be rotated to a retracted position after detachment.

The wick 6 is located at the center of the fuel tank 2, the igniter 10 is provided at the side of the wick 6, and, as in the Fifteenth Embodiment, the cap 115 is provided with the inner cap 116.

A guide member 45, constituted as a shaft member, is attached to an interior portion of the so-structured cap 115 at an eccentric location near the peripheral wall. The lower portion of guide member 45 is inserted into an edge portion of the fuel tank 2 to be slidable in the attachment/detachment direction, i.e., in the vertical direction. By this, the cap 115 is supported to be movable along the guide member 45 in the attachment/detachment direction and to be rotatable about the guide member 45.

Energizing means 46 (a torsion coil) is fit over the guide member 45. One end of the torsion coil 46 is fastened to the inner surface of the cap 115 and the other end thereof is fastened to the edge of the fuel tank 2. The cap 115 is thus biased in the rotating direction and acted on by an upward biasing force.

At least a portion of the peripheral edge of the upper end of the fuel tank 2 is formed with an upwardly projecting peripheral wall 47. The peripheral wall 47 is formed to be low at the portion of the igniter 10 and to be high in the vicinity of the wick 6. It is provided with air holes 47*a*. The peripheral wall 47 serves the dual functions of a windshield and a guide for the cap 115 at the time of attachment and detachment.

In this embodiment, when the cap 115 has been fitted on the fuel tank 2 to seal the wick 6 with the inner cap 116, the energizing means 46 is wound in the twisting direction and compressively deformed in the axial direction.

In the course of removing the cap 115 to use the lighter, the lower end of the inner cap 116 first rises out of engagement with the seal member 31 of the wick holder 7. In this state, the position of the cap 115 is such that it would collide with the tip portion of the wick 6 and the igniter 10 if rotated. This does not occur, however, because the cap 115 is moved upward along the peripheral wall 47 by the force of the energizing means 46 until out of the collision range. When the lower end of the cap 115 has risen above the tip of the wick 6 and the tip of the igniter 10, the torsional force of the energizing means 46 automatically rotates the cap 115 around the guide member 45 from its position above the fuel tank 2 to a retracted position. When the cap 115 is to be closed after use, it is rotated in the opposite direction to position it above the fuel tank 2 and is then pressed downward into engagement along the guide member 45.

This embodiment facilitates the operation of removing the cap 115 at the beginning of use and also prevents loss of the cap 115.

Although this embodiment is provided with the energizing means (torsion coil) 46 for automatically rotating the cap 115 to the retracted position, it is instead possible adopt a configuration without the energizing means, in which case the cap 115 is manually rotated to the retracted position. Further, instead of providing the guide member 45 to move together with the cap 115 in the direction of attachment and detachment, it is possible to adopt a configuration in which the cap 115 is made slidable relative to a fixed guide member 45 or in which the guide member 45 is made plate-like and the member for slidingly supporting it is made rotatable.

<Twenty-First Embodiment>

Figure 29:
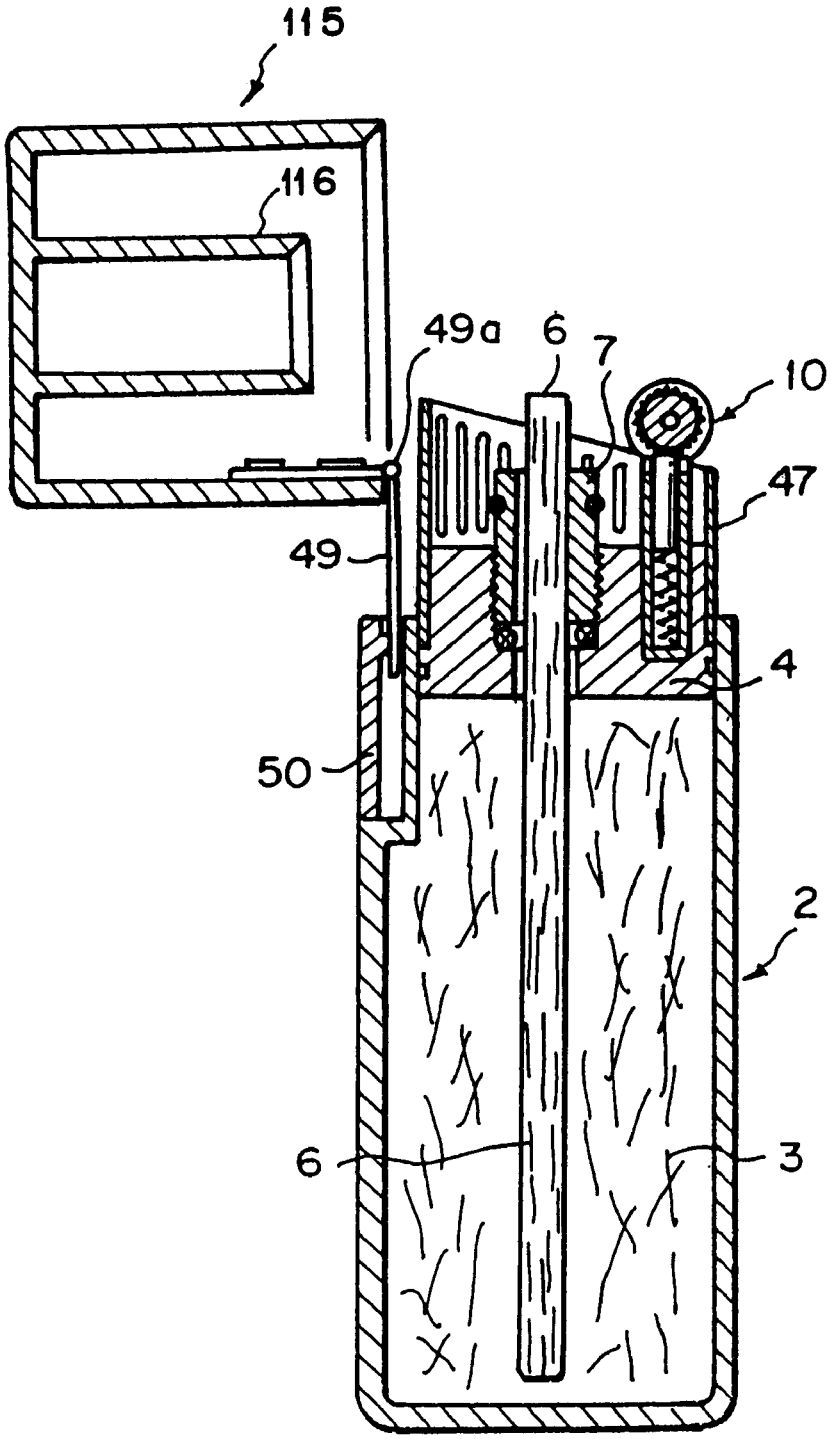
FIG. 29 is a sectional view of an essential portion of a lighter that is a twenty-first embodiment.

An essential structural feature of the lighter of this embodiment is shown in FIG. 29. While the preceding embodiment rotates the cap 115 to a retracted position, this embodiment is configured to tilt the cap 115 into a retracted position by bending a guide member 49.

The guide member 49 is provided near the location where the cap 115 fits on the top cover 4 of the fuel tank 2 to guide the cap 115 in the attachment/detachment direction. It is constituted as a leaf spring having an intermediate hinge 49*a*. The cap 115 is attached to the guide member 49 above the hinge 49*a*. The portion of the guide member 49 below the hinge 49*a* is retained on the fuel tank 2 to be vertically slidable by use of a retaining member 50. The guide member 49 also structurally includes energizing means for biasing the cap 115 to fall over in the bending direction in the course of swinging in an upward arc about the hinge 49*a*. The other portions are formed like those of the Twentieth Embodiment.

In this embodiment, when the cap 115 is raised from the closed state, it first separates from its engagement with the fuel tank 2 and, after rising a certain distance to a position where it is out of the way of the igniter 10 etc., is automatically tilted and moved to the retracted position by the force acting in the tilting direction about the hinge 49*a* of the guide member 49.

Alternatively, the energizing means can be omitted from the embodiment to provide a configuration requiring the cap 115 to be manually swung along the upward arc.

<Twenty-Second Embodiment>

Figure 30B:
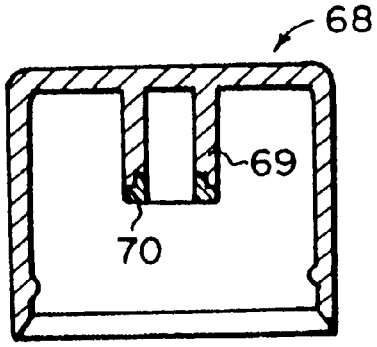
FIGS. 30A and 30B show sectional views of the essential portion of a lighter that is a twenty-second embodiment, with the cap attached and detached.
Figure 30A:
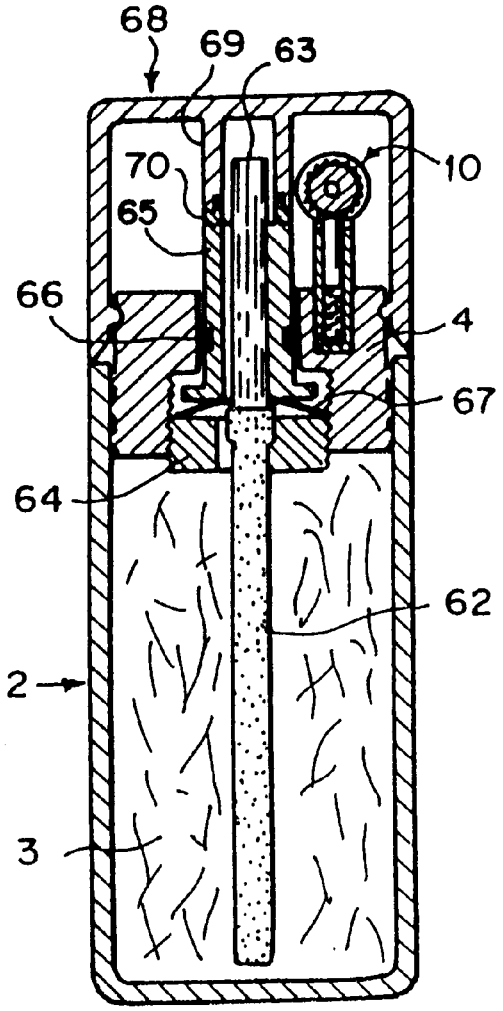
Figure 30A:
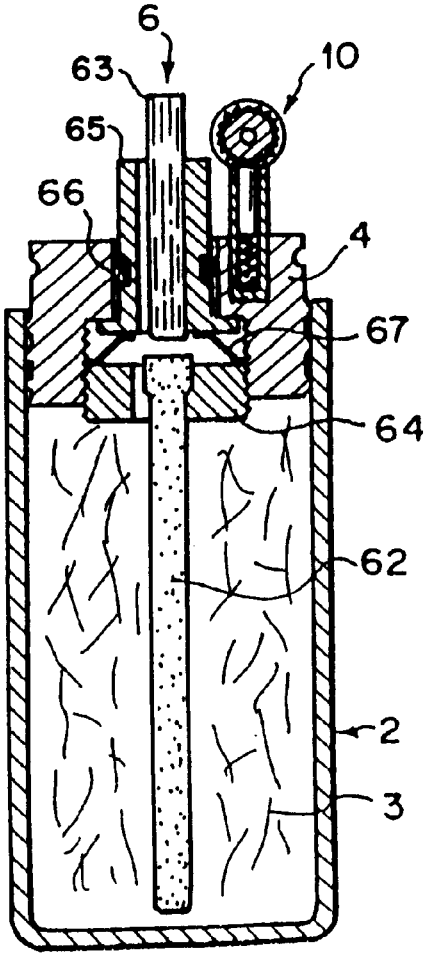

An essential structural feature of the lighter of this embodiment is shown in FIGS. 30A and 30B. In this embodiment the wick 6 is divided into two segments to enable rationed burning.

In a configuration similar to that of the Sixth Embodiment, an air passage is formed by a groove provided in the inner hole of a wick holder 65. The materials of the flame-producing section 63 and the draw-up section 62 of the wick 6 are like those of the Eleventh Embodiment. Use of other materials is also possible, however. For instance, a flame-producing section 63 made of glass fibers or of a porous glass sintered body is also suitable.

The wick holder 65 is inserted into the top cover 4 with a seal ring 66 interposed therebetween. The lower end of the wick holder 65 rests on an elastic member 67 (a disk spring) supported on the upper surface of a holding member 64. The elastic member 67 biases wick holder 65 in the separating direction (upward). When the flame-producing section 61 has been moved upward by the force of the elastic member 67, the lower end of the flame-producing section 61 separates from the upper end of the draw-up section 62 to form a gap between the two.

A seal member 70 is fixed on the tip portion of an inner cap 69 of an openable/closable cap 68 for covering the flame-producing section 63 of the wick 6. The lower surface of the seal member 70 is adapted strike on the upper surface of the wick holder 65 and press the wick holder 65 downward. When the cap 68 is shut, it strikes on and presses the wick holder 65 downward against the force of the elastic member 67 to bring the lower end of the flame-producing section 63 into contact with the upper end of the draw-up section 62 and simultaneously covers and seals flame-producing section 63. A ridge-valley engagement structure is further provided between the inner peripheral surface of the cap 68 and the outer peripheral surface of the top cover 4.

The gap produced between the flame-producing section 63 and the draw-up section 62 at separation need only be large enough to break the contact. One of around 1 mm or even smaller is sufficient. The elastic member 67 is not limited to a disk spring but can instead be any of various other types such as a rubber member, multiple small-diameter coil springs or a large-diameter coil like that in the Tenth Embodiment.

Although the flame-producing section 63 is adapted to make and break contact in response to attachment and detachment of the cap 68 in the foregoing embodiment, it is alternatively possible to secure automatic extinguishment capability by mounting on the fuel tank 2 a screw mechanism, rubber mechanism or the like for vertically moving the flame-producing section 63, and providing an operation member for operating this mechanism, whereby the flame-producing section 63 can be moved for making and breaking of contact by an operation of the user.

The embodiments of the invention described in the foregoing enable the operations for attaching and detaching the cap to be conducted along a straight path coinciding with the direction of protrusion of the wick from the fuel tank. In conformity with this movement, the seal structures at the sealing portions can be simplified. Moreover, the linear locus of the cap corresponding its movement along a straight path reduces interference with other components and, as such, enables compact component layout and simplifies design.

<Tests>

An invention lighter according to the First Embodiment and a comparison lighter of the same structure except for omission of the air passage were tested to ascertain the effect of forming the air passage.

(1) Change in flame length during continuous burning

Figure 31A:
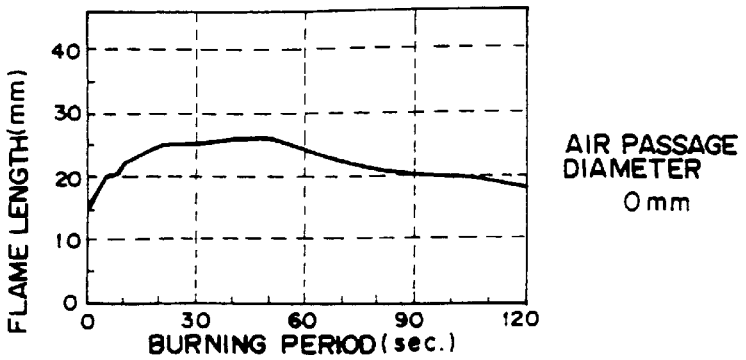
FIGS. 31A–31B are set of graphs showing how flame length varied as a function of post-ignition burning period at different air passage diameters.
Figure 31B:
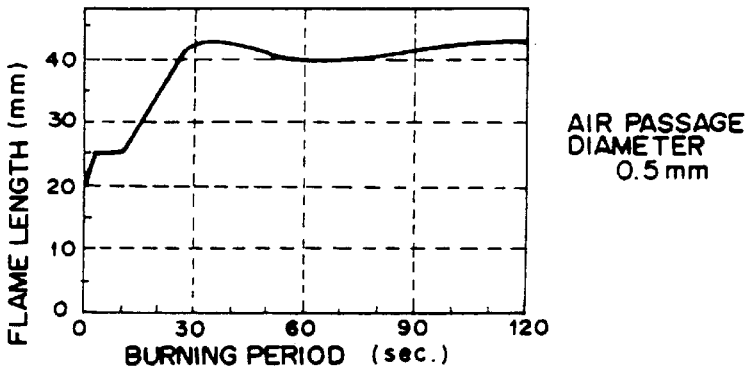
Figure 31C:
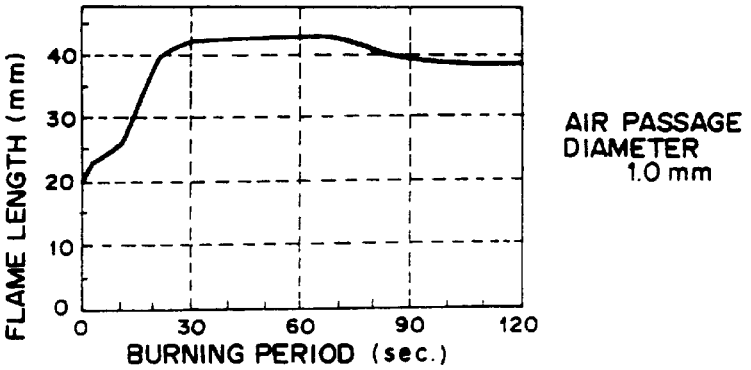
Figure 31D:
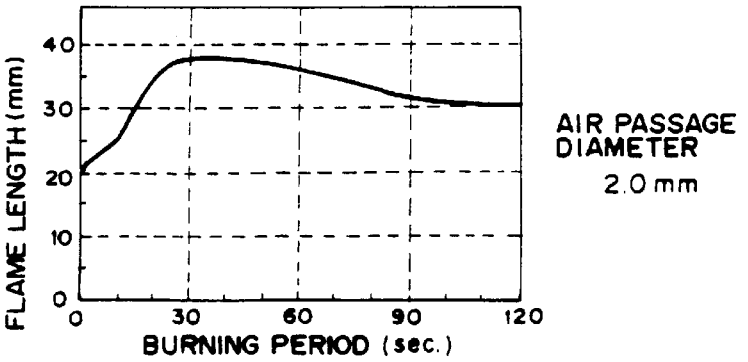

The wicks of lighters formed with different diameter air passages were lit and the change in flame length during 120 seconds of continuous burning was measured. The results are shown in FIGS. 31A–31D. The results are shown in FIG. 31(A) for a lighter with an air passage diameter of 0 mm, i.e., the comparison lighter, and in FIGS. 31(B), 31(C) and 31(D) for invention lighters with air passage diameters of 0.5 mm, 1.0 mm and 2.0 mm, respectively.

Figure 32:
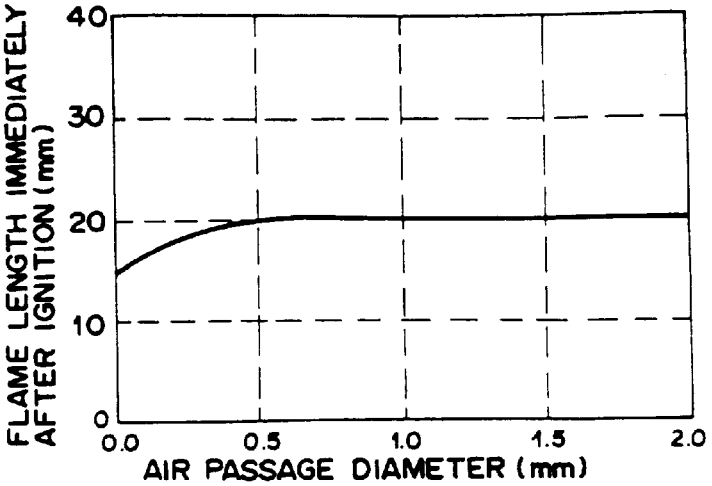
FIG. 32 is a graph showing how flame length immediately after ignition varied as a function of air passage diameter.

FIG. 32 shows how the flame lengths immediately after ignition in the measurement of FIGS. 31A–31D varied as a function of air passage diameter. It will be noted that the flame length immediately after ignition was 20 mm in the invention lighters having air passages as compared with 15 mm in the comparison lighter having no air passage.

Figure 33:
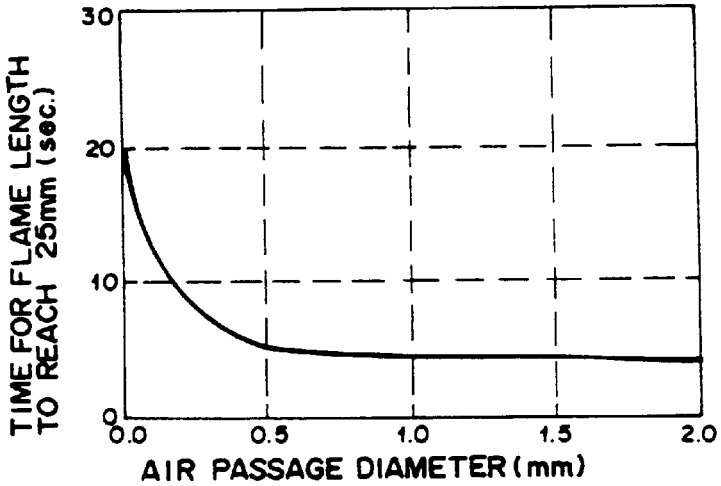
FIG. 33 is a graph showing how time for flame length to reach 25 mm varied as a function of air passage diameter.

FIG. 33 shows how time for flame length to reach 25 mm varies as a function of air passage diameter. It will be noted that the time required for the flame length to reach 25 mm was 5 seconds in the case of the invention lighters as compared with 20 seconds in the case of comparison lighter.

Figure 34:
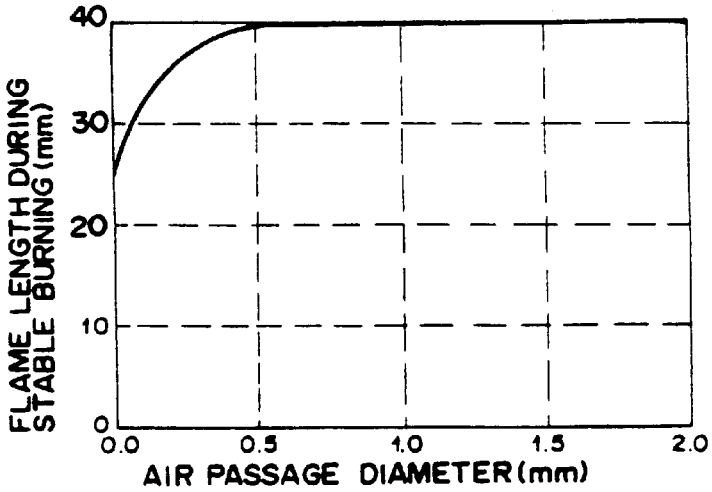
FIG. 34 is a graph showing how stable state flame length varied as a function of air passage diameter.

FIG. 34 shows how stable state flame length varied as a function of air passage diameter. While the flame length stabilized with in about 20–30 seconds of burning following ignition, the flame length at this time was 25 mm in the case of the comparison lighter with no air passage but was 40 mm in the invention lighters provided with air passages.

The significance of the foregoing results will be considered. Although FIGS. 31A–31D show the change in flame length measured during 120 seconds of continuous burning, what is important in actual use of a lighter is the flame length immediately after ignition or within a period of around 10–20 seconds after ignition. Considering this point in light of FIGS. 32 and 33, it can be seen that the flame length immediately after ignition of the lighter with no air passage was short, that provision of the air passage made the flame length longer, and that approximately the same results were obtained at different air passage diameters in the range of 0.5–2.0 mm. While each of the flames first grew with passage of time following ignition and then stabilized at a certain length, provision of the air passage enabled the flame to grow rapidly to a length suitable for use.

Moreover, as can be seen from FIG. 34, the stabilized flame length after a certain burning time was markedly longer in the lighters having the air passage than in the lighter without it. In other words, the maximum flame length at a given amount of protrusion of the flame-producing section of the wick is increased by providing the air passage. This means that the amount of wick protrusion can be reduced. Since the size of the sealing portion of the cap for preventing escape of vaporized fuel from the wick can be reduced when the amount of protrusion is smaller, the lighter can be made more compact.

(2) Liquid fuel leakage

The wick portion was observed for leakage of liquid fuel when the ambient temperature was varied. The results are shown in Table 1. The wick portion was also observed for leakage of liquid fuel when the ambient pressure was varied ±20% relative to atmospheric pressure. The results are shown in Table 2.

When the ambient temperature increased and when the ambient pressure decreased, the comparison lighter with no fire-lighting device experienced leakage of liquid fuel from the wick because the internal pressure of the fuel tank became higher than the external pressure, while the invention lighters did not experience such leakage because the pressure differential was eliminated through the air passages.

TABLE 1

| Temp. change | Air passage diameter (mm) | | | |
|---|---|---|---|---|
| (Base temp: 23° C.) | 0 | 0.5 | 1.0 | 2.0 |
| −20° C. | ○ | ○ | ○ | ○ |
| 0° C. | ○ | ○ | ○ | ○ |
| +20° C. | x | ○ | ○ | ○ |
| +30° C. | x | ○ | ○ | ○ |

(○: No leakage x: Leakage)

TABLE 2

| Air pressure change (From atmospheric pressure) | Air passage diameter (mm) | | | |
|---|---|---|---|---|
| | 0 | 0.5 | 1.0 | 2.0 |
| −20% | x | ○ | ○ | ○ |
| +20% | ○ | ○ | ○ | ○ |

(○: No leakage x: Leakage)

The embodiments of the invention described in the foregoing thus provide burners using liquid fuel, particularly lighters and other fire-lighting devices for starting fires, which, being provided with an air passage along the fuel passage (wick) to communicate the interior of the fuel tank with the exterior in order to make the flame length after ignition as long as possible and increase the growth rate of the flame length after ignition, achieve better results than a burner not provided with an air passage. In addition, the length of the wick for securing a given flame length can be shortened and the length of the sealing cap for preventing escape of vaporized fuel from the wick during non-use can be therefore be shortened to simplify device design, while, by also providing the air passage inside this sealed portion, escape of vaporized liquid fuel through the air passage can be prevented and oozing of liquid fuel with change in ambient temperature and ambient air pressure can also be prevented.

What is claimed is:

1. A liquid fuel burner comprising:

a fuel tank containing fuel to be burned and having a bottom wall and side walls terminating in an upper perimeter and having a top wall spanning the upper perimeter of the side walls and having a portion with a substantially planar surface extending normal to the side walls;

a wick extending into the fuel tank through a first opening formed in and extending through the substantially planar surface portion of the top wall for burning liquid fuel drawn up therethrough by capillarity, an air passage communicating through a second opening formed in and extending through the substantially planar surface portion of the top wall which is separate from and laterally spaced from the first opening between an interior of the fuel tank and external air at least during burning, and a cap movable between open and closed positions and attached to the fuel tank in both the open and closed positions, the cap having an internal space and a seal at an open end of the cap surrounding an opening to the internal space, the seal engaging the substantially planar surface portion of the top wall in the closed position of the cap to enclose the wick in the internal space and to seal the first and second openings from external air when the burner is not in use.

2. A liquid fuel burner comprising:

a wick for burning liquid fuel drawn up therethrough by capillarity from a fuel tank, the wick being divided into two segments at least one of which is movable to contact and separate from the other, fuel being supplied from one segment to the other during contact and fuel supply being cut off during separation to limit burning period, a cap for sealingly enclosing the wick when the burner is not in use, means for separating the two segments upon removal of the cap from the wick, and an air passage communicating an interior of the fuel tank with external air at least during burning.

3. A liquid fuel burner according to claim 1 or 2 wherein the cap is an openable/closable closure cap for preventing fuel vaporization by sealing a flame-producing section of the wick and the opening of the air passage to external air is formed to communicate with the internal space sealed by the closure cap in its closed state.

4. A liquid fuel burner according to claim 1 or 2 wherein the cap is an openable/closable cap for preventing fuel vaporization by sealing a flame-producing section of the wick and the opening of the air passage to external air is formed to be closed by the seal of the closure cap in its closed state.

5. A liquid fuel burner according to claim 1 or 2 wherein the cap is an openable/closable closure cap for preventing fuel vaporization by sealing a flame-producing section of the wick and an air passage closure member provided on or ganged with the closure cap, the air passage closure member opening/closing an opening of the air passage to external air simultaneously with operation of the closure cap to open/close the flame-producing section of the wick.

6. A liquid fuel burner according to claim 1 or 2, characterized in that the air passage is constituted as a gap along a wick holder provided to surround the outer periphery of the wick or as a groove formed in an inner surface of the wick holder.

7. A liquid fuel burner according to claim 1 or 2, characterized in that the air passage is constituted by a capillary tube extending along the wick.

8. A liquid fuel burner according to claim 1 or 2, characterized in that the air passage is constituted as a groove.

9. A disposable liquid fuel burner comprising:

a fuel tank constituted as a sealed structure charged with a fiber material and containing, but not refillable with, liquid fuel and having a bottom wall, side walls terminating in an upper perimeter and a top wall spanning the upper perimeter of the side walls and having a portion with a substantially planar surface extending normal to the side walls with spaced first and second openings formed in and extending through the substantially planar surface portion, a wick having one end which is a draw-up section inserted in the fuel tank through the first opening in the top wall to contact the fiber material and draw up liquid fuel by capillarity and having another end which is a flame-producing section retained by a wick holder to project from the top of the fuel tank, an openable/closable closure cap movable between open and closed positions and attached to the fuel tank in both the open and closed positions, the cap having an internal space and a seal at an open end of the cap surrounding an opening leading to the internal space, the seal engaging the substantially planar surface portion of the top wall in the closed position of the cap to enclose the wick in the internal space and sealing at least the flame-producing section of the wick when the burner is not in use, an igniter installed near the flame-producing section of the wick for lighting the flame-producing section, and an air passage provided by the second opening capable of communicating an interior and exterior of the fuel tank through a portion apart from fuel passages of the wick, the second opening being closed by the cap from the exterior of the fuel tank when the cap is in the closed position.

10. A liquid fuel burner comprising:

a fuel tank for holding liquid fuel and having side walls and an upper wall with a substantially planar surface portion extending normal to the side walls with spaced first and second openings formed in and extending through the substantially planar surface portion;

a wick extending through the first opening in the upper wall portion and adapted to burn liquid fuel drawn up therethrough, an igniter for lighting the wick extending through the upper wall of the fuel tank, an air passage provided by the second opening communicating an interior of the fuel tank with external air at least during burning provided at a location apart from fuel passages of the wick, a cap for sealing an upper end of the fuel tank from which the wick and the igniter protrude supported for sliding motion in a straight path along a direction of wick protrusion to fit over and cover the upper end of the fuel tank from above at one end of the straight path and being laterally movable away from the upper end of the fuel tank at the other end of the straight path, and a seal member interposed at a sealing portion of the cap to engage the substantially planar surface portion when the cap is at said one end of the straight path.

11. A liquid fuel burner according to claim 10, characterized in that the seal member is interposed between an outer peripheral portion of the fuel tank and the cap.

12. A liquid fuel burner according to claim 10, characterized in that the cap is internally equipped with an inner cap that is operated in unison with an operation for attaching/detaching the cap to/from the fuel tank to seal the wick through an interposed seal member.

13. A liquid fuel burner according to claim 12, characterized in that the inner cap of the cap is guided to seal the wick by a peripheral fitting portion between the fuel tank and the cap during attachment/detachment of the cap to/from the fuel tank.

14. A liquid fuel burner according to claim 12 or 13, characterized in that the inner cap is attached to the cap through an elastic member that enables sealing of the wick with the seal member maintained under pressure.

15. A liquid fuel burner according to claim 12 or 13, characterized in that the inner cap is disposed eccentrically relative to the cap and a surface orthogonal to a direction of attachment/detachment at a peripheral fitting portion of the cap and the fuel tank is shaped to have radial asymmetric directionality.

16. A liquid fuel burner according to claim 12 or 13, characterized in that the inner cap is disposed eccentrically relative to the cap and a surface orthogonal to a direction of attachment/detachment at a peripheral fitting portion of the cap and the fuel tank is shaped to have radial symmetry.

17. A liquid fuel burner according to claim 10 or 12, characterized in that an upper end of the fuel tank is provided about at least part of its outer periphery with an upwardly projecting peripheral wall.

18. A liquid fuel burner according to claim 10 or 12, characterized in that it comprises a guide member for slidingly guiding the cap in the attachment/detachment direction relative to the fuel tank and further enabling the cap to move from over the wick and the igniter to a retracted position after it has moved to or beyond a position where it disengages from the fuel tank.

19. A liquid fuel burner according to claim 18, characterized in that the guide member is constituted as a shaft member for guiding the cap in the attachment/detachment direction relative to the fuel tank to a position where a lower end of the cap is higher than tip portions of the wick and the igniter, the shaft member being connected to the cap at a point apart from its center and the cap being adapted to rotate to the retracted position about the shaft member.

20. A liquid fuel burner according to claim 18, characterized in that the guide member is provided midway with a hinge and the cap is movable to the retracted position by swinging in an upward arc about the hinge.

21. A liquid fuel burner according to claim 18, characterized in that energizing means is provided for biasing the cap from a slid position on the guide member to the retracted position.

22. A liquid fuel burner according to any of claims 10 to 13 wherein the wick is divided into two segments at least one of which is movable to contact and separate from the other, fuel being supplied from one segment to the other during contact and fuel supply being cut off during separation.

* * * * *